US009463143B2

(12) United States Patent
Oates, II et al.

(10) Patent No.: US 9,463,143 B2
(45) Date of Patent: Oct. 11, 2016

(54) APPARATUS AND METHODS FOR ORAL ADMINISTRATION OF FLUIDS AND MEDICAL INSTRUMENTATION

(71) Applicant: PEDIA SOLUTIONS LLC, San Diego, CA (US)

(72) Inventors: Robert Bradley Oates, II, San Diego, CA (US); Brian Paul Brock, Tempe, AZ (US)

(73) Assignee: Pedia Solutions, LLC, San Diego, CA (US)

( * ) Notice: Subject to any disclaimer, the term of this patent is extended or adjusted under 35 U.S.C. 154(b) by 0 days.

(21) Appl. No.: 14/250,734

(22) Filed: Apr. 11, 2014

(65) Prior Publication Data

US 2014/0221917 A1 Aug. 7, 2014

Related U.S. Application Data

(63) Continuation of application No. 14/062,736, filed on Oct. 24, 2013, now Pat. No. 8,945,182, which is a continuation-in-part of application No. PCT/US2013/037492, filed on Apr. 19, 2013.

(Continued)

(51) Int. Cl.
*A61J 1/06* (2006.01)
*A61J 17/00* (2006.01)
(Continued)

(52) U.S. Cl.
CPC ..... *A61J 17/00* (2013.01); *A61J 7/0053* (2013.01); *A61J 17/006* (2015.05); *A61J 2015/008* (2013.01); *A61J 2017/006* (2013.01)

(58) Field of Classification Search
CPC ..... A61J 1/05; A61J 1/067; A61J 7/0053; A61J 17/006; A61M 15/003; B65D 17/161; B65D 17/163; B65D 17/165; B65D 17/166; B65D 17/168
USPC ..... 604/403; 206/528–540, 570, 571; 222/107, 541.6, 541.9; 383/207–209
See application file for complete search history.

(56) References Cited

U.S. PATENT DOCUMENTS 3,353,714 A 11/1967 Trecek
3,862,684 A * 1/1975 Schmitt ..... 206/277
(Continued)

FOREIGN PATENT DOCUMENTS

JP 11-100050 A 4/1999
WO WO 02/22073 3/2002
(Continued)

OTHER PUBLICATIONS

PCT/US2013037492 International Search Report dated Jul. 4, 2013.
(Continued)

*Primary Examiner* — Kathleen Holwerda
(74) *Attorney, Agent, or Firm* — Foley & Lardner LLP

(57) ABSTRACT

Methods and devices for orally administering fluids and medical instrumentation to individuals for the promotion of health are disclosed. An apparatus is described comprising a pacifier configured to hold fluid and configured for sucking. In some embodiments, the apparatus includes a balloon positioned within a cavity of the pacifier. The balloon is configured to facilitate expulsion of the fluid from the cavity and to limit a user's ingestion of air. In other embodiments, the apparatus includes a cartridge or ampoule configured to store a fluid and expel the fluid through the pacifier. Systems are disclosed which include the pacifier apparatus, a known quantity of fluid or powder, and sterile packaging. Other systems are disclosed whereby various attachments, both medical and non-medical, couple to the apparatus. Methods of using and methods of manufacturing are also disclosed.

29 Claims, 32 Drawing Sheets

Related U.S. Application Data

(60) Provisional application No. 61/636,401, filed on Apr. 20, 2012, provisional application No. 61/659,360, filed on Jun. 13, 2012, provisional application No. 61/709,053, filed on Oct. 2, 2012, provisional application No. 61/802,141, filed on Mar. 15, 2013.

(51) Int. Cl.
*A61J 7/00* (2006.01)
*A61J 15/00* (2006.01)

(56) References Cited

U.S. PATENT DOCUMENTS

| | | | | |
|---|---|---|---|---|
| 3,993,223 | A * | 11/1976 | Welker et al. | 222/107 |
| 4,358,028 | A * | 11/1982 | Chiquiar-Arias | 222/107 |
| 4,493,324 | A | 1/1985 | Johnston | |
| 4,869,720 | A | 9/1989 | Chernack | |
| 4,903,698 | A | 2/1990 | Huber et al. | |
| 4,921,137 | A * | 5/1990 | Heijenga | 222/107 |
| 5,013,321 | A | 5/1991 | MacVane | |
| D334,064 | S | 3/1993 | Fitzpatrick | |
| 5,242,422 | A * | 9/1993 | Schneberger et al. | 604/216 |
| 5,354,274 | A | 10/1994 | Demeter et al. | |
| 5,512,047 | A | 4/1996 | Dvorak | |
| 5,582,330 | A * | 12/1996 | Iba | 222/212 |
| 5,601,605 | A | 2/1997 | Crowe et al. | |
| 5,620,462 | A | 4/1997 | Valenti | |
| 5,772,685 | A | 6/1998 | Crowe et al. | |
| 5,827,233 | A | 10/1998 | Futagawa et al. | |
| 5,830,193 | A | 11/1998 | Higashikawa | |
| 5,843,030 | A | 12/1998 | Van Der Merwe | |
| 5,868,131 | A | 2/1999 | Murchie | |
| 5,899,883 | A | 5/1999 | Chern et al. | |
| 6,110,193 | A | 8/2000 | Chen | |
| 6,126,678 | A | 10/2000 | Aaltonen et al. | |
| 6,139,566 | A | 10/2000 | Bennett | |
| 6,241,124 | B1 * | 6/2001 | Hoyt | 222/143 |
| 6,360,916 | B1 * | 3/2002 | Sokolsky et al. | 222/107 |
| 6,454,788 | B1 | 9/2002 | Ashton | |
| 6,695,869 | B2 | 2/2004 | Fitzpatrick et al. | |
| 6,702,462 | B2 * | 3/2004 | Richardson | 383/200 |
| 7,032,590 | B2 * | 4/2006 | Loeffler et al. | 128/200.24 |
| D558,354 | S | 12/2007 | Roehrig | |
| D574,963 | S | 8/2008 | Kliegman et al. | |
| 7,753,886 | B2 | 7/2010 | Vath et al. | |
| D626,653 | S | 11/2010 | Roehrig et al. | |
| D636,496 | S | 4/2011 | Roehrig et al. | |
| 8,118,773 | B2 | 2/2012 | Stewart | |
| 8,133,259 | B2 | 3/2012 | Roehrig et al. | |
| D686,331 | S | 7/2013 | Dussere | |
| 8,622,213 | B2 | 1/2014 | Lynn et al. | |
| 2004/0124168 | A1 | 7/2004 | Silver | |
| 2005/0125038 | A1 | 6/2005 | Inbar et al. | |
| 2006/0169664 | A1 | 8/2006 | Miller et al. | |
| 2006/0201967 | A1 | 9/2006 | Romer | |
| 2007/0164045 | A1 * | 7/2007 | Wydler et al. | 222/106 |
| 2009/0182308 | A1 | 7/2009 | Hagbi | |
| 2010/0147885 | A1 | 6/2010 | Braxton et al. | |
| 2010/0258589 | A1 | 10/2010 | Smith et al. | |
| 2010/0270330 | A1 * | 10/2010 | Caldwell et al. | 222/107 |
| 2011/0046671 | A1 | 2/2011 | Okoturo | |
| 2011/0166476 | A1 | 7/2011 | Crawford et al. | |
| 2011/0240587 | A1 | 10/2011 | Cohn | |
| 2014/0051926 | A1 | 2/2014 | Oates, II et al. | |

FOREIGN PATENT DOCUMENTS

| | | |
|---|---|---|
| WO | WO 03/013419 | 2/2003 |
| WO | WO 2009/033202 | 3/2009 |
| WO | WO 2013/159073 | 10/2013 |

OTHER PUBLICATIONS

International Search Report and Written Opinion dated Mar. 12, 2015 in PCT Application Serial No. PCT/US2014/062274, 21 pages.

* cited by examiner

Figure 3A
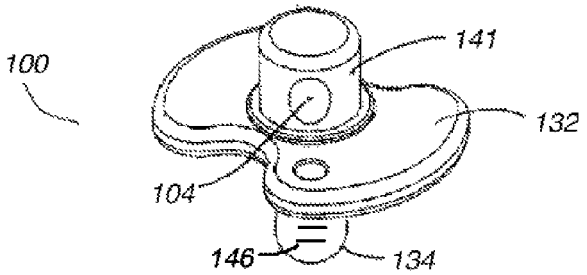
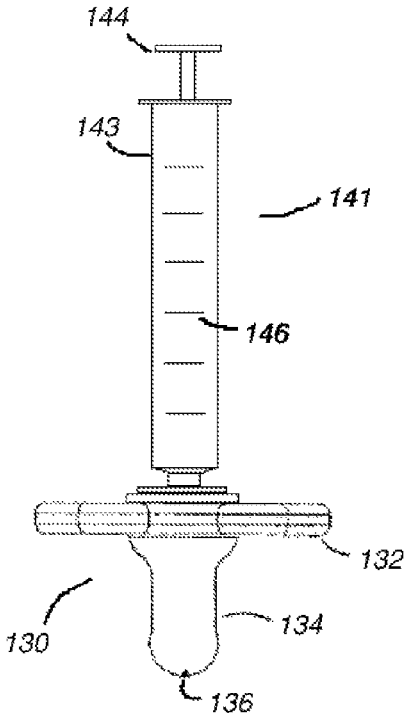
Figure 3B
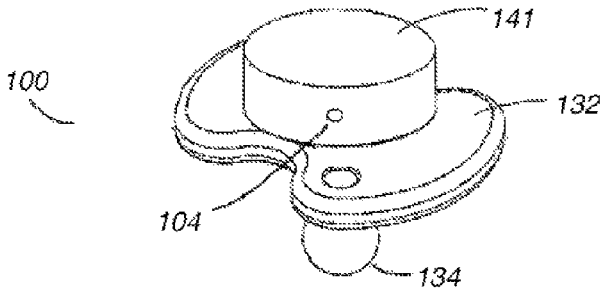
Figure 4A

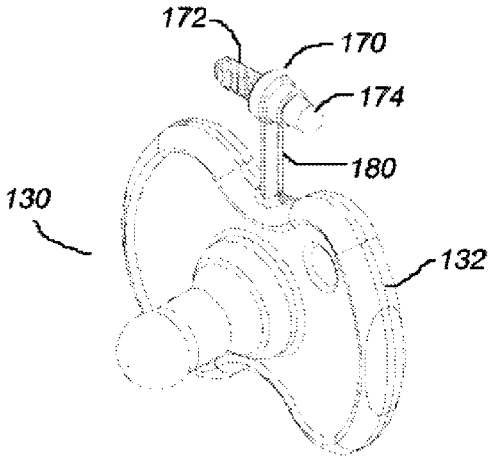
Figure 17A
Figure 17B
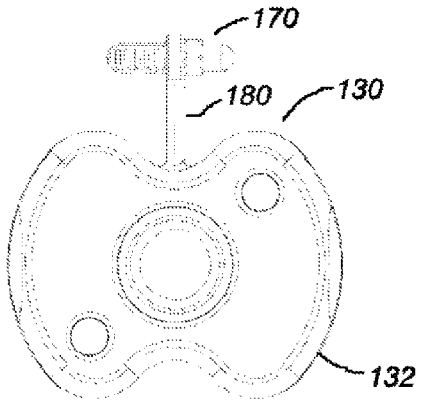
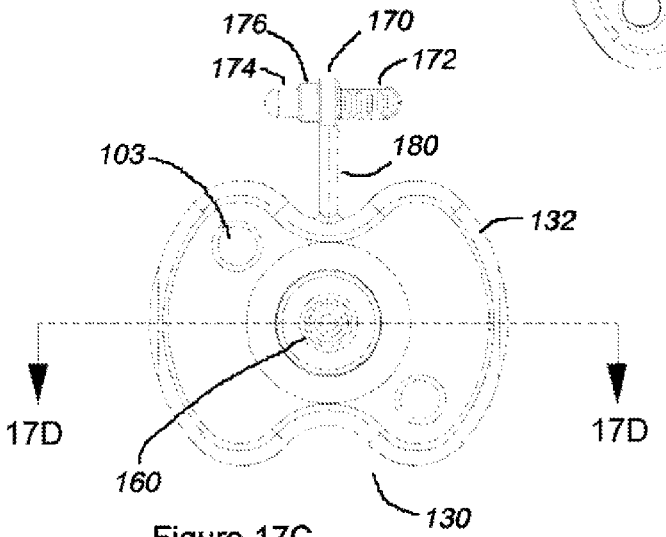
Figure 17C
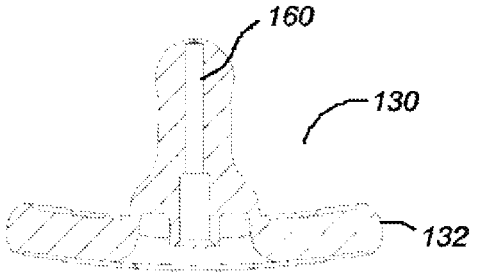
Figure 17D

APPARATUS AND METHODS FOR ORAL ADMINISTRATION OF FLUIDS AND MEDICAL INSTRUMENTATION

INCORPORATION BY REFERENCE TO ANY PRIORITY APPLICATIONS

This application is a continuation of U.S. application Ser. No. 14/062,736, filed Oct. 24, 2013, which is a continuation-in-part application of International Application No. PCT/US2013/037492 filed Apr. 19, 2013, which claims priority to U.S. Provisional Application 61/636,401 filed Apr. 20, 2012, U.S. Provisional Application 61/659,360 filed Jun. 13, 2012, U.S. Provisional Application 61/709,053 filed Oct. 2, 2012, and U.S. Provisional Application 61/802,141 filed Mar. 15, 2013. Each of the above-identified applications is hereby incorporated by reference in its entirety.

BACKGROUND

1. Field of the Invention

Embodiments disclosed herein relate to apparatuses, systems, and methods for administering fluids and medical devices. More particularly, the present disclosure describes a pacifier apparatus and related systems and methods for the oral delivery of fluids and medical instrumentation to promote health and well-being.

2. Description of the Related Art

Often when a neonate, infant, child, or any infirmed or injured individual is a patient in a hospital, the individual will receive multiple fluids and medications. The individual may also be attached to one or more medical devices and undergo one or more medical procedures during the hospital stay. The entire experience can be stressful and overwhelming. Patients benefit from being soothed and comforted while in the hospital.

Many parents and caregivers use pacifiers to relax and soothe their young children and to help them sleep. The most popular pacifier designs are rather simple devices formed of a nipple and a mouth guard. Many young children find comfort in a variety of settings by suckling on such pacifier nipples. Currently, a pacifier in the mouth of a patient must be removed before medications, fluids, or medical instrumentation can be administered orally.

SUMMARY

Circumcision, venipuncture, and diagnostic examinations are just a few of the painful and traumatic procedures to which newborns and infants are subjected. Several studies have shown that the neurons that convey painful stimuli are well developed in the newborn brain, and systemic stress from a painful stimulus may negatively affect major body systems. Accordingly, in recent years, the medical industry has begun to seek methods and apparatuses for reducing the pain experienced by infants during painful procedures. Studies have shown sucrose administration to be a safe and effective means of reducing procedural pain in the newborn. Other clinical research suggests that non-nutritive sucking in conjunction with sucrose intake provides a synergistic analgesic effect. Accordingly, medical centers are increasingly developing protocols for orally administering a sucrose serum to infants prior to performing painful medical procedures. In many hospitals, these protocols involve dipping a pacifier or a gloved practioner's finger into a sucrose solution and inserting it into an infant's mouth. Recently, more advanced pacifiers have been developed for dispensing sucrose, such as those discussed by Crowe et al. U.S. Pat. No. 5,772,685 and Stewart U.S. Pat. No. 8,118,773. However, there are many shortcomings associated with currently available designs.

Many existing pacifiers require that the fluid be injected into the device at the site where the procedure takes place. These designs lack an understanding of one of the most valuable and scarce resources in a healthcare facility—time. Previous devices and methods also include complex devices with multiple moving pieces and other advanced features. Such devices tend not to be user friendly, disposable, or well suited for one-time procedural use. Moreover, most current devices are not suitable for neonates who have not yet developed the ability to extract a fluid through sucking, due to prematurity of intraoral musculature, ankyloglossia, or the like.

Available devices also neglect the lifecycle of pre-procedural, intra-procedural and post-procedural pain. Studies have shown that the peak effects of sucrose are delayed for two minutes upon administration and the analgesic response to sucrose lasts nearly four minutes. Also, post-procedural symptoms such as tachycardia, increased breathing, and pain can be mitigated through additional ingestion of sucrose after a procedure. Recent studies suggest that for optimal analgesic effect to occur, a controlled dose of an analgesic over a given period of time is superior to larger, uncontrolled quantities of analgesic given in a shorter period of time. Accordingly, a need exists for a device which can adjust for procedural time by expressing a precise and targeted amount of fluid during a short duration procedure, while also extending the expression time to provide post-procedural analgesic effects during a longer procedure. However, such devices are lacking in the market. There is still a gaping need for a fluid dispensing/fluid administration apparatus that requires minimal effort to prepare on the part of a health care practitioner and can also provide an analgesic effect (or other comfort/relief) throughout the length of a procedure and post-procedure.

The market also lacks a device which can express, store, and orally administer colostrum using, in part, a fluid administration device specifically tailored for premature infants and other neonates. Colostrum is known to contain antibodies, growth factors, and anti-inflammatory agents important for the development of a child's immune system. It is important for all infants, even those who have not yet developed the ability to extract a fluid through sucking, to receive their mother's colostrum soon after birth.

Currently available fluid administration devices also fail to sufficiently address the problems that exist in the outpatient, home use, and commercial markets where issues related to currently available devices have recently led to recalls of major fever and pain relieving drugs. A need exists for a fluid administration apparatus configured to expel a precise and targeted dosage of fluid to an infant or other individual. It would be particularly advantageous to have a fluid administration apparatus capable of administering a targeted dosage of a medicament to an infant or patient in a soothing and familiar manner with a controlled flow rate. A need also exists for a fluid administration apparatus that allows infants to ingest a premeasured amount of medication at their own natural rate of suckling.

Additionally, the market, especially the hospital market, currently lacks a device that can be used as a soother, and when necessary, can be used as a medical delivery platform as well. It would be advantageous to have a soothing pacifier that can receive multiple medical accessories and devices, such as, for example, for the oral delivery of catheters, imaging scopes, intubation tubes, and/or transitional feeding attachments.

As a result of these gaps in the market, a need exists for an improved device capable of addressing one or more of the above-mentioned needs.

Disclosed herein are various embodiments of a fluid administration apparatus or pacifier, and related systems and methods, which may fill one or more of the aforementioned needs of the inpatient and outpatient markets. It is conceived that embodiments of the present technology may be used to administer any desired substance, including for example, analgesics, probiotic cultures, vitamins, nutritive solutions, colostrum, breast milk, antibiotics, anti-gas solutions, over-the-counter medicaments, other liquid medicaments, and other fluids. Some embodiments may additionally or alternatively be used as a medical platform used in the oral delivery of medical instrumentation.

While various examples disclosed herein are directed to neonates, infants, and/or children, this is merely done to simplify the description. It should be understood that the present embodiments are in no way limited to use within those exemplified populations. All apparatuses, systems, methods, and kits disclosed herein may also be used with geriatric populations and children and/or adults who struggle with oral-muscular activities, such as swallowing solid foods, due to disability or incapacitation. Additionally, embodiments disclosed herein may be utilized in a veterinary setting.

Some embodiments of the disclosed apparatus and system: are disposable, limit a receiving individual's ingestion of air, and/or provide a mechanism for expelling fluid into the mouth of a receiving individual when the individual is unwilling or unable to suck. Some embodiments of the devices, systems, and kits disclosed herein are configured to dispense fluid at any angle regardless of the position of the fluid-receiving individual. Additionally or alternatively, some embodiments provide a measurement of the amount of fluid expelled from the fluid-administrating apparatus. In some embodiments disclosed herein, the apparatus provides a controlled flow rate upon actuation (e.g., squeezing by a caregiver and/or sucking by a fluid-receiving individual) to ensure adequate fluid administration, prevent unnatural flow, and eliminate gag and choking responses.

It should be understood that the apparatuses, systems, and methods of the present technology have several features, no single one of which is solely responsible for the desirable attributes described herein. Without limiting the scope, as expressed by the claims that follow, the more prominent features will be briefly disclosed here. After considering this discussion, one will understand how the features of the various embodiments provide several advantages over traditional pacifiers and current fluid administration devices.

Several embodiments of the present technology are directed to a pacifier apparatus configured for administering fluid. In one disclosed embodiment, the pacifier apparatus includes, at least, a nipple base and a nipple. The nipple base of some embodiments includes, for example, a proximal face, a distal face, and a passage wall defining a passage extending through the base, and the nipple extends proximally from the proximal face. The nipple of some embodiments includes, for example, a nipple wall having a distal end coupled to the nipple base and a nipple aperture at a proximal tip. The nipple wall defines a cavity configured to hold a fluid, and the nipple of various embodiments is configured to expel the fluid through the nipple aperture in response to the nipple being sucked.

The pacifier apparatus of some embodiments also includes a balloon. The balloon of some embodiments has, for example, a body and a distal mouth coupled to the nipple base, and the balloon of some embodiments is configured to transition from at least a substantially undeployed state to a substantially deployed state in response to the nipple being sucked. In the deployed state of various embodiments, the balloon body is configured to extend into the cavity and substantially block the passage of air through the nipple aperture, signal complete medicine intake, and eliminate further fluid flow. In some embodiments of the apparatus, the balloon, in the deployed state, has a size and shape relatively comparable to the size and shape of the nipple. In such embodiments, the balloon is configured to substantially line an inner perimeter of the nipple wall when fully deployed. Deployment of the balloon may facilitate expulsion of fluid from the nipple cavity through the nipple aperture.

Some embodiments of the apparatus further include a rigid member positioned at least partially within the passage of the nipple base. The rigid member of some embodiments is configured to provide a mechanism for securing the distal mouth of the balloon relative to the nipple base, and in some embodiments, the distal mouth of the balloon is affixed around or within the rigid member.

The pacifier apparatus of some embodiments further includes a pump. In various embodiments, the pump may be configured as an alternate mechanism for expelling solution from the device and/or for transitioning the balloon toward the deployed state and for thereby expelling fluid from the nipple aperture. In some embodiments, the pump is shaped, for example, as a syringe having a syringe body and a plunger. In some embodiments, the rigid member extends from the pump and is configured for positioning within the passage of the nipple base. The rigid member may be integrally coupled to the pump, for example. In some such embodiments, the apparatus further includes, for example, a locking ring positioned around the distal mouth of the balloon such that the distal mouth and the locking ring are positioned between the rigid member and the passage wall, securely coupling the distal mouth of the balloon, the locking ring, the rigid member, and the nipple base together. In some of these embodiments, at least a portion of the locking ring is affixed within the nipple base. The rigid member of some embodiments includes a coupling element, for example, a ridge, a perforation, an indentation, or threading for coupling the rigid member to the locking ring. In one embodiment, the balloon mouth is positioned around a proximal portion of the rigid member, and a distal portion of the rigid member, which includes the coupling element, is configured to couple directly to the locking ring. In another embodiment, the rigid member is configured to couple indirectly to the locking ring, with the distal mouth of the balloon positioned between the coupling element of the rigid member and the locking ring.

In some embodiments, the apparatus further includes a pump base fixedly connected to a proximal end of the pump. In some such embodiments, the rigid member extends proximally from the pump base and is configured for positioning within the passage of the nipple base. In such embodiments, at least a proximal portion of the rigid member is configured to securely engage the distal mouth of the balloon and be positioned within the passage of the nipple base, and a distal portion of the rigid member is configured to securely engage the pump base. In some such embodiments, the rigid member may be integrally connected with the pump base.

In other embodiments, the rigid member extends proximally from a rigid plate and is positioned within the passage of the nipple base. In some embodiments, the rigid plate includes a distally extending handle. In the alternative or in addition, the rigid plate of some embodiments includes a second rigid member extending distally from the rigid plate. In some such embodiments, the second rigid member is configured to engage with a pump. In others, the second rigid member is configured to engage with a pump base. In some embodiments, a pump in the form of a syringe extends from, and removably couples to, the rigid plate. In various embodiments, the apparatus additionally or alternatively includes one or more anchors extending from the rigid plate and/or from the pump or pump base, which are configured to extend through a plurality of holes in the nipple base to fixedly secure the rigid plate and/or the pump to the nipple base.

In another disclosed embodiment, an apparatus for administering fluid includes a pacifier apparatus having an integral, unitary body. In some embodiments, the unitary pacifier includes, for example, a nipple base having a distal face and a proximal face, a nipple extending proximally outward from the proximal face, and optionally, a handle extending distally outward from the distal face. The nipple of some embodiments includes, for example, a nipple wall configured for sucking, and the nipple wall and a portion of the proximal face define a substantially closed cavity configured to hold a fluid. The pacifier of several embodiments also includes, for example, a nipple aperture at a proximal tip of the nipple and a distal opening to the cavity in the nipple base.

In other embodiments, the unitary pacifier apparatus includes, for example, a nipple base having a distal face, a proximal face, and a passage wall defining a passage extending through the nipple base, a nipple extending proximally outward from the proximal face, and a depressible pump extending distally outward from the distal face. The nipple of various embodiments includes, for example, a nipple wall configured for sucking, and the depressible pump includes a compressible wall configured for squeezing or applying force. The nipple wall and compressible wall each connect with the passage wall to define a cavity configured to hold a fluid. The pacifier of some embodiments further includes, for example, a nipple aperture at a proximal tip of the nipple and a distal opening to the cavity through the depressible pump. In some embodiments, the distal opening to the cavity includes, for example, one or more of a valve, a hole, a slit, and a frangible seal. In some of the above-mentioned embodiments, the pacifier apparatus having a unitary body is formed of a material that includes one or more of silicone, plastic, rubber, and other polymers.

In another disclosed embodiment, a pacifier apparatus configured for administering fluid includes, for example: a nipple base having a proximal face, a distal face, and a passage extending through the nipple base; and a nipple extending proximally from the proximal face and having a nipple wall, which defines a cavity, is configured for sucking, and has a nipple aperture at or near a proximal tip. In some embodiments, the nipple aperture is disposed along a bulbous proximal end of the nipple offset from the proximal tip; in some such embodiments, the distal opening to the cavity is axially aligned with the off-center nipple aperture. The apparatus of this embodiment can be configured, for example, to securely couple to a cartridge such that at least a portion of the cartridge is positioned within the passage and the cavity. In some embodiments, the apparatus includes a receiving tube disposed within the cavity and the passage, wherein the receiving tube is sized and configured to securely couple to a proximal portion of a cartridge. In some embodiments, the apparatus may include a plurality of receiving tubes disposed within the cavity and the passage. In some embodiments, these one or more receiving tubes run along a length of the nipple wall.

In another disclosed embodiment, a nipple apparatus, such as a pacifier, is configured for the oral administration of healthcare products. Healthcare products is a broad term encompassing any product, composition, or device used in the promotion of health or treatment of disease, including, for example, medicines, nutritional supplements, vitamins, nutraceuticals, breast milk, analgesics, fluids, colostrum, and any healthcare accessory, such as, for example, imaging scopes, intubation tubes, and enteral feeding syringes. In some embodiments, the nipple apparatus includes: a nipple base having a proximal face, a distal face, and a passage extending through the nipple base; a nipple extending proximally from the proximal face, the nipple defined by a contoured nipple wall having a nipple aperture disposed on a proximal end of the nipple wall; a receiving tube extending through the nipple and at least a portion of the passage, the receiving tube having a proximal portion which terminates at the nipple aperture; an attachment mechanism disposed in or on the receiving tube for attaching the receiving tube to a healthcare accessory; and an occlusion mechanism coupled to the receiving tube for selectively occluding the receiving tube. The occlusion mechanism may be any suitable structure which non-permanently occludes the flow of air through the receiving tube. Such a structure may limit the ingestion of air by a user. In some embodiments, the occlusion mechanism includes one or more valves, which selectively occlude the receiving tube by remaining closed and occluding the flow of air through the receiving tube until acted on by a force, such as, for example, the insertion of a cartridge into the receiving tube or the expulsion of fluid from the cartridge. In other embodiments, the occlusion mechanism includes one or more plugs. Such plugs are removably coupled to the receiving tube, and can be inserted into, or removed from, a distal end of the receiving tube to selectively control occlusion of air through the receiving tube. In other embodiments, the occlusion mechanism includes one or more healthcare accessories, which when coupled to, and disposed at least partially within, the receiving tube, occlude the flow of air through the receiving tube. In some embodiments, the attachment mechanism includes threading, snap fitting, slip fitting, friction fitting, or other coupling features to couple the receiving tube to a healthcare accessory, such as, for example, a cartridge.

The cartridge to which the apparatus may be configured to couple includes, for example, a reservoir configured to hold a fluid and a cartridge aperture at a proximal tip or end of the cartridge. In some embodiments, the cartridge also includes, for example, a pump, a repeatably deformable wall, or other actuator for causing the fluid to be expelled from the reservoir. When such a cartridge is properly coupled, the apparatus is configured to expel a fluid from the reservoir through the cartridge aperture and out of the apparatus through the nipple aperture at least in response to the pump being squeezed. Additionally or alternatively, in some embodiments, the cartridge is configured to expel a fluid from the reservoir through the cartridge aperture and out the apparatus through the nipple aperture at least in response to experiencing negative pressure from an infant's suck.

An embodiment of a system for dispensing fluid is also disclosed. In one embodiment, the system includes, for example, a cartridge containing a predetermined volume of a predetermined fluid. The cartridge includes a reservoir configured to hold a fluid and a cartridge aperture at a proximal tip of the cartridge. The cartridge may also include a pump or other actuating features on a distal portion of the cartridge. As used herein throughout the specification and claims, the term "cartridge" is used to describe any ampoule, vial, syringe, or other container configured to hold and expel a quantity of liquid. In some embodiments, the cartridge is hermetically sealed. The seal may be wholly or partially removable. In some such embodiments, both the cartridge and the seal are sized so as not to pose a choking hazard to young children. In some embodiments, such a cartridge is manufactured using a blow fill seal, injection molding, or other process. In one embodiment, the reservoir may be in the form of a syringe body and the pump may be in the form of a plunger. The cartridge of various embodiments is configured to securely couple to the apparatus described in the previous paragraph or elsewhere herein. Such a cartridge may also be used independently to expel fluid into the mouth of an infant or other individual.

In some embodiments, the system is further configured for a single use; in some embodiments, the system includes at least one disposable cartridge and a reusable pacifier apparatus having the characteristics described in the previous paragraph or elsewhere herein. In some embodiments, the cartridge is prefilled with a predetermined volume of a liquid. A kit is also disclosed, which includes a plurality of the cartridges described above. In some embodiments, the kit also includes a pacifier apparatus, such as the ones described in the previous paragraph or elsewhere herein, which can be configured to couple to each of the plurality of cartridges individually and interchangeably.

In some embodiments of the apparatuses disclosed herein, the apparatus is configured to deliver a metered quantity of fluid. Some embodiments may be configured to expel fluid from the cavity through the nipple aperture at a desired, predetermined, and/or constant rate. For example, the apparatus of some embodiments is configured to expel fluid at an average rate of 0.0001 mL/s, the apparatus of other embodiments is configured to expel fluid at an average rate of 0.01 mL/s, and the apparatus of other embodiments is configured to expel fluid at an average desired rate therebetween, when sucked by a neonate and/or when the pump is squeezed. Additionally, in many but not all embodiments, the apparatus is disposable and/or adapted for one-time use.

The nipple base of various embodiments may be overmolded and the proximal face and the distal face may be curved proximally inward so as to be adapted to fit the curvature of a face. In some embodiments, a center height of the proximal face is shorter than an edge height of the proximal face, and a center height of the distal face is shorter than an edge height of the distal face. With such a configuration, the nipple base has a shape adapted to provide space between the nipple base and a child's nose when the nipple is positioned within a child's mouth. In some embodiments, the nipple base further includes a plurality of through-holes configured to allow the passage of air between the distal face and the proximal face. In some embodiments, these through-holes securely but reversibly retain a plug disposed on a strap, and the strap is fixedly connected to the nipple base. The strap of such embodiments is flexible so as to allow for movement of the plug between a through-hole and a distal opening of a receiving tube.

In various embodiments, the nipple aperture is in the form of a slit or a hole. In some embodiments, the nipple aperture is positioned on the proximal tip of the nipple; in other embodiments, the nipple aperture is positioned elsewhere on the proximal end of the nipple, for example, on the bulbous portion of the nipple, offset from the proximal tip. Such an offset may mitigate choking of fluid and gag reflex. In some embodiments, the distal opening to the cavity is in the form of a slit, hole, valve, or frangible seal.

Additionally, systems for administering fluid are disclosed herein. In one embodiment, the system includes: a pacifier apparatus configured for administering fluid, such as the apparatuses described herein; a fluid stored within the cavity, wherein the fluid has a known volume; and a sterile packaging unit surrounding the apparatus. In one particular embodiment, the fluid includes 2 mL of sucrose solution. In other embodiments, different volumes and/or different fluids are used. In some embodiments, the fluid includes one or more of a probiotic formula, a vitamin formula, a nutritive formula, breast milk, colostrum, sweetened water or other fluid, an anti-gas fluid (e.g., simethicone (Mylicon®)), or a liquid medication. In another embodiment of the system, the system includes a pacifier apparatus configured for administering fluid as disclosed herein, a liquid-filled gel capsule positioned within the cavity, and a sterile packaging unit surrounding the apparatus. In such an embodiment, a coating of the liquid-filled gel capsule may be configured to dissolve when subjected to a known environmental trigger, such as, for example, heat sterilization, to release fluid into the cavity. In an additional embodiment, the fluid or liquid-filled gel capsule is replaced with a powder stored within the cavity, wherein the powder has a known mass and is configured to dissolve in water. In some embodiments, the powder includes a lyophilized solution. The entire system of some embodiments is configured for one-time use.

In various embodiments of the system, the sterile packaging unit may include, for example, a shell having a distal shell member, a proximal shell member, and an attachment element configured to detachably connect the distal shell member and the proximal shell member. Moreover, the shell of some embodiments has an inner surface, an outer surface, and a plurality of anchor arms extending from the inner surface into an interior of the shell. The plurality of anchor arms are configured to secure the apparatus in a stable position inside the shell, for example, by engaging with a plurality of through-holes located in the nipple base. In some embodiments, the attachment element includes a pull seal configured to wrap substantially around a circumference of the shell and a pull-tab affixed to an end of the pull seal. The pull seal is configured to fixedly couple the distal shell member to the proximal shell member until the pull-tab is pulled and the pull seal is removed. The pull seal of some embodiments is attached to a proximal end of the distal shell member and a distal end of the proximal shell member via a perforated connection. The sterile packaging unit may additionally include a double-sided adhesive pad positioned on the inner surface, which is configured to contact the nipple aperture and seal it closed while positioned in the packaging unit. In the alternative, the sterile packaging unit may include, for example, a stub anchor extending from the inner surface into an interior of the shell, which is configured for insertion into the nipple aperture to prevent fluid from leaking.

In some embodiments, one or more of the systems and/or components, as described herein, are packaged together to form a kit. In one embodiment, the kit includes a plurality of systems having a plurality of age-specific nipple sizes. In some such embodiments, the nipples within the kit each have an age-specific nipple aperture size. The nipples of the apparatuses within the kit are selected such that the sizes are tailored to cover a spectrum of age groups. The kits of some embodiments further include an outer packaging container. In other embodiments, the kits may include, for example, an apparatus as described herein and one or more medicaments that can be used with the apparatuses, or an apparatus and a cartridge that is configured to be inserted in and used with the apparatus. Some embodiments described in more detail herein relate to the cartridges of medicaments or fluids themselves.

Another system for administering fluid is disclosed which includes a pacifier apparatus, such as the apparatuses described above, a breast pump, and a mechanism to, or means of, connecting the breast pump directly or indirectly to at least a portion of the pacifier apparatus. In some embodiments, the breast pump can be coupled directly or indirectly to the nipple of the pacifier apparatus such that breast milk or colostrum can be pumped through the nipple aperture and into the nipple cavity. In other embodiments, the breast pump can be coupled directly or indirectly to the nipple base, one or more receiving tubes disposed within the nipple, and/or the pump of the pacifier apparatus, such that milk or colostrum can be pumped through an opening in the nipple base or an opening in the pump of the pacifier apparatus. In still other embodiments, the breast pump can be coupled directly or indirectly to a cartridge configured for insertion into a pacifier apparatus. In various embodiments, the mechanism to, or manner of, connecting the breast pump to at least a portion of the pacifier apparatus includes, for example, tubing, piping, a valve, funnel, blunt tip needle, or other conduit for directing the flow of fluids. It should be understood that in some embodiments, the fluid can be extracted from the mother by the breast pump and then transferred to a device or apparatus as described herein via any suitable method. For example, the fluid in the breast pump can be transferred by pouring, via a syringe, via syringe and needle, via a pump, via tubing and gravity, etc.

Some embodiments relate to methods of manufacturing a pacifier apparatus configured for administering fluid. In one embodiment, the method includes, for example, positioning a distal mouth of a balloon around at least a proximal portion of a rigid member such that an air passage exists between a body of the balloon and a hole located on a distal portion of the rigid member or on a pump coupled to the distal portion of the rigid member. The method of some embodiments also includes, for example, permanently affixing the distal mouth of the balloon to at least the proximal portion of the rigid member, and vacating air from the air passage to retract the balloon into an undeployed state. Additionally, the method of some embodiments includes forming a unitary pacifier body, wherein the pacifier body includes a nipple base and a nipple. The nipple base has, for example, a proximal face, a distal face, and a passage extending through the nipple base. The nipple extends proximally outward from the proximal face and includes, for example, a nipple wall, which defines a cavity. In some embodiments, the method further includes securely affixing the balloon mouth and at least the proximal portion of the rigid member to the passage wall, forming a nipple aperture through a proximal tip of the nipple wall, vacating air from the cavity, and filling the cavity with a predetermined volume of fluid. The method may additionally include sealing the nipple aperture temporarily so as to prevent fluid from spilling from the cavity.

In some embodiments, forming a nipple aperture includes, for example, making a slit in or near the proximal tip of the nipple wall. In other embodiments, forming a nipple aperture includes, for example, puncturing a hole in or near the proximal tip of the nipple wall. In some embodiments, filling the cavity with a desired volume of fluid includes, for example, injecting the known volume of fluid into the cavity through the nipple aperture. In other embodiments, filling the cavity with a known volume of fluid includes, for example, squeezing the pump, inserting the nipple aperture into a fluid, releasing the pump, and removing the nipple aperture from the fluid when a desired quantity of the fluid has entered the cavity. Vacating air from the cavity includes, for example, vacuuming air from the cavity through the nipple aperture. In other embodiments, vacating air from the cavity includes, for example, expelling air from the nipple aperture by forcing air into the air passage so as to transition the balloon into a fully deployed state. In some embodiments of the method, the step of vacating air from the cavity by forcing air into the air passage may be performed before the step of vacating air from the air passage to retract the balloon into an undeployed state, for example. In other embodiments, the steps may be performed in any desired and/or logical order. In some embodiments, permanently affixing the balloon mouth to at least the proximal portion of the rigid member includes, for example, applying an adhesive between the balloon mouth and the rigid member. In other embodiments, the step includes, for example, fusing the balloon mouth to the rigid member using ultrasonic welding. In still other embodiments of the method, the step includes, for example, fixating an outer locking ring around the balloon mouth after it has been positioned around at least the proximal portion of the rigid member.

In an additional embodiment for a method of manufacture, the method includes, for example: molding a unitary pacifier body comprising (1) a nipple base comprising a proximal face, a distal face, and a passage wall defining a passage extending through the nipple base, and (2) a nipple extending proximally outward from the proximal face and having a nipple wall which defines a cavity; forming a nipple aperture through the nipple wall in or near the proximal tip; inserting a balloon through the passage and into the cavity with the balloon in a deployed state; inserting a proximal end of a rigid member into a distal mouth of the balloon such that the rigid member is fixedly coupled directly or indirectly to the passage wall upon insertion; and filling the cavity with a known volume of fluid. In some embodiments, the rigid member is tapered to facilitate insertion into the distal mouth of the balloon.

In an additional embodiment of a method of manufacturing a pacifier apparatus, the method includes, for example: molding a unitary nipple assembly comprising (1) a nipple base comprising a proximal face, a distal face, and a passage wall defining a passage extending through the nipple base, and (2) a nipple extending proximally outward from the proximal face and having a nipple wall which defines a cavity; forming a nipple aperture through a proximal tip of the nipple wall; inserting a receiving tube into the cavity and/or molding the nipple so that the cavity is configured to form a receiving tube, wherein the receiving tube is sized and shaped to securely receive a proximal portion of a fluid-filled cartridge. The receiving tube of some embodiments may have various non-uniform diameters along the length of the receiving tube to control the rate of fluid flow by creating high and low pressure channels. In some embodiments, the method may include inserting or forming a plurality of receiving tubes within the nipple of the pacifier. In other embodiments, the method may include molding a valve into the receiving tube to occlude air ingestion until acted upon by a force. In some embodiments, the method also includes molding or attaching a strap with a plug to a nipple base. In one embodiment of using such an apparatus, the method includes removing a seal from the cartridge aperture of the cartridge, inserting a proximal portion of the cartridge into the receiving tube of a nipple assembly, inserting a nipple of the nipple assembly into the mouth of an individual, and actuating the cartridge by deforming a distal portion of the cartridge such that a liquid flows from a reservoir of the cartridge, through the cartridge aperture, through the nipple aperture, and into the mouth of the individual. In some embodiments, a plug can be placed into a through-hole of the nipple base so that the plug is out of the way when the cartridge is coupled to the receiving tube, and the plug can be positioned within a distal end of the receiving tube once the cartridge has been removed. In some embodiments, positioning the plug within the distal end of the receiving tube limits the individual's ingestion of air as they suck on the nipple of the nipple assembly.

A method of manufacturing an age-specific pacifier apparatus configured to administer fluids is also disclosed. In some embodiments, the method includes: determining an average number of sucks performed in a defined length of time by patients of a pre-defined age group; determining a desired length of fluid administration; determining a desired volume of fluid to be administered; calculating an optimum flow rate by dividing the desired volume by the desired length of fluid administration and performing a unit conversion step if necessary; calculating an optimum volume of fluid expelled per suck by dividing the optimum flow rate by the average number of sucks performed in a defined length of time and performing a unit conversion step if necessary; selecting a desired nipple wall thickness, a desired nipple wall density, a desired cavity volume, a desired nipple aperture size, and a desired size of a distal cavity opening, which are together configured to achieve a desired average pressure change within the nipple during a suck and thereby achieve the optimum volume of fluid expelled per suck; molding a pacifier apparatus comprising a base and nipple from a polymeric material, wherein the nipple is molded to have the desired nipple wall thickness and the desired nipple wall density, and wherein the cavity is sized to hold the desired volume of fluid; and puncturing a proximal tip of the nipple to create a nipple aperture having the desired nipple aperture size and a distal end of the pacifier apparatus to create a distal cavity opening having the desired distal cavity opening size. Some embodiments of the method further include filling the cavity with the desired volume of fluid to be administered. The fluid may be filled through the nipple aperture or the distal cavity opening. In other embodiments, the size, shape, strength, and/or position of a receiving tube and/or nipple aperture are selected to achieve a desired angle of fluid expulsion or a desired rate of fluid expulsion when a given negative pressure is applied to the nipple.

A method of providing comfort to a child is also described. In various embodiments of the method, the child may be positioned at any angle. The method includes, for example, providing a pacifier apparatus as described herein to a child that is positioned at any angle, wherein the apparatus includes, at least, a pump or actuatable cartridge, a nipple, and a nipple aperture. A fluid is stored within a nipple cavity or a cartridge reservoir. The apparatus of some embodiments also includes a balloon. The method further includes inserting the apparatus into the child's mouth for sucking, wherein sucking and/or actuating the pump or cartridge causes at least a portion of the fluid to flow from the cavity or reservoir through the nipple aperture and into the mouth. In some embodiments, sucking causes the balloon to gradually transition from an at least partially or substantially undeployed state to a substantially deployed state in which the balloon is positioned in the cavity and forms the general shape of the nipple upon deployment. Additionally, if the child does not suck on the nipple or does not suck forcefully enough, for example, to transition the balloon into the deployed state, the method may include actuating the pump or cartridge to expel fluid from the cavity or reservoir into the child's mouth. In some embodiments, actuating the pump transitions the balloon into the deployed state, which thereby expels the fluid from the cavity.

In an additional embodiment, the method of providing comfort to a child includes providing a pacifier apparatus filled with solution, wherein the apparatus is structured in accordance with any of the embodiments disclosed herein, positioning the apparatus into the mouth of a child so that the child can suck on the apparatus and thereby cause the solution to flow from the apparatus, and if necessary and/or desired, manipulating a pump on the device in order to expel the solution into the mouth of the child if the child does not suck on the device or if the sucking of the child is insufficient to cause a desired amount of solution to flow from the apparatus. In some embodiments, the pump used within the method is, for example, a depressible pump. various embodiments, the comfort provided to the child can be one or more of soothing the child and providing a medicament to the child, for example. In some embodiments, the solution includes, for example, one or more of a sweetened solution, a medicament, water, baby formula, breast milk, colostrum, or any other fluid as described herein or otherwise desired. In accordance with various embodiments of the method, the child may be positioned so as to be at an angle of between about 0 degrees and 180 degrees relative to horizontal. Embodiments are conceived in which the child receives the apparatus while undergoing a medical procedure or examination or when otherwise agitated or upset. The methods can include providing comfort or treatment of a child or patient suffering from or going through an illness, discomfort, or a medical treatment or procedure. For example, the discomfort may be caused by gas, an upset stomach, an injury, or any other cause. The medical treatment or procedure can be one or more of circumcision, receiving a shot, a blood prick or puncture, a diagnostic examination, etc. The illness can be a fever, a cold, a flu, etc.

BRIEF DESCRIPTION OF THE DRAWINGS

The above-mentioned features, as well as other features, aspects, and advantages of the present technology will now be described in connection with various embodiments of the invention, in reference to the accompanying drawings. The illustrated embodiments, however, are merely examples and are not intended to limit the invention.

FIG. 3A depicts a perspective view of an embodiment of a pacifier apparatus configured for the oral administration of fluids, wherein the apparatus includes a pump.

FIG. 3B depicts a side view of another embodiment of a pacifier apparatus configured for the oral administration of fluids, wherein the apparatus includes a pump in the form of a syringe.

FIG. 4A depicts a perspective view of another embodiment of a pacifier apparatus configured for the oral administration of fluids and having a pump.

FIG. 17A depicts a perspective view of another embodiment of a nipple assembly configured to receive a cartridge.

FIG. 17B depicts a top/proximal view of the nipple assembly embodiment of FIG. 17A.

FIG. 17C depicts a bottom/distal view of the nipple assembly embodiment of FIG. 17A.

FIG. 17D depicts a cross-sectional view of the nipple assembly embodiment of FIG. 17A. The selected viewing angle of the cross-section is identified in FIG. 17C.

DETAILED DESCRIPTION OF CERTAIN EMBODIMENTS

Figure 1A:
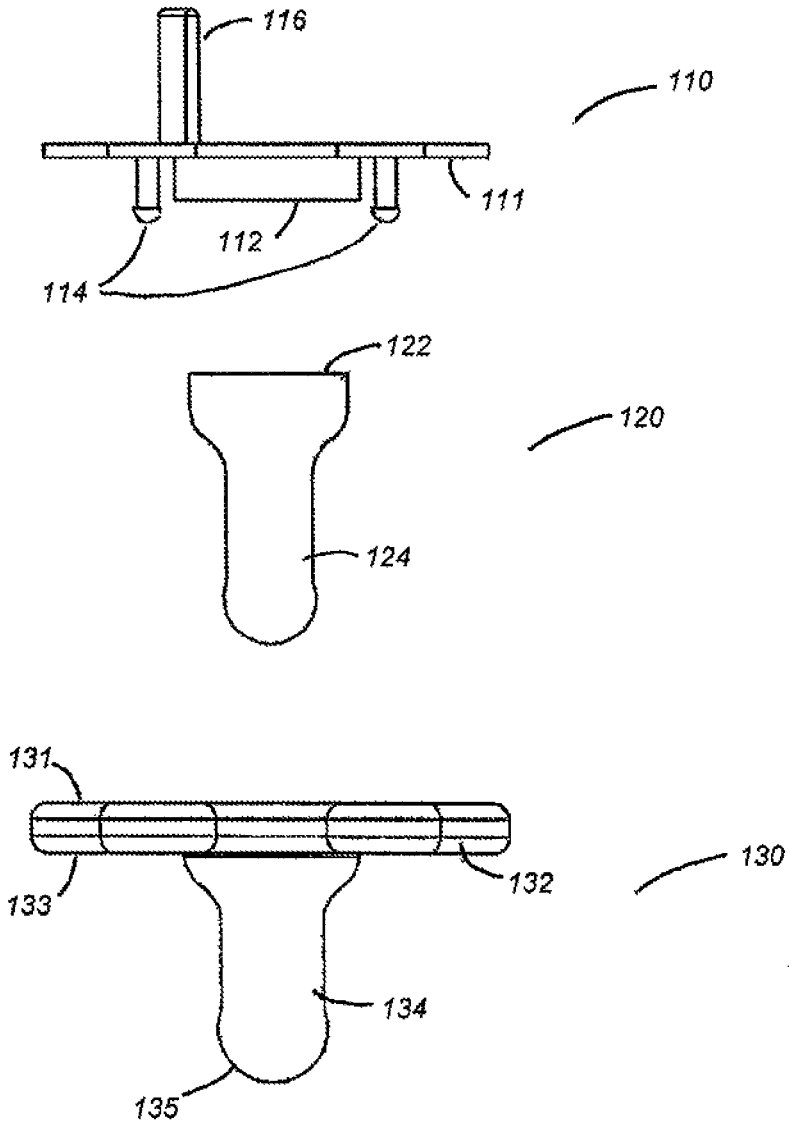
FIG. 1A depicts an exploded side view of one embodiment of a pacifier apparatus configured for the oral administration of fluids.

In the following detailed description, reference is made to the accompanying drawings, which form a part of the present disclosure. In the drawings, similar symbols typically identify similar components, unless context dictates otherwise. The illustrative embodiments described in the detailed description, drawings, and claims are not meant to be limiting. The detailed description is intended as a description of exemplary embodiments and is not intended to represent the only embodiments which may be practiced. The term "exemplary," as used herein, means "serving as an example, instance, or illustration," and should not necessarily be construed as preferred or advantageous over other embodiments. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure.

As noted above, embodiments described herein generally relate to apparatuses, systems, and methods of administering fluids or medical instrumentation to a patient, such as, for example, an infant child. One or more of the provided embodiments may overcome one or more of the drawbacks, limitations, or deficiencies that exist in the inpatient and outpatient markets. For example, in some embodiments, the apparatuses are single use, disposable, pre-loaded with a desired substance, configured to dispense a desired amount of fluid over a given period of time, and configured to dispense fluid upon actuation. In some embodiments, the apparatuses are actuated via sucking by the patient and/or pumping or squeezing by a care giver. In some embodiments, the apparatuses, systems, kits, and methods provide a more simple, efficient, and safe device for fluid administration. In some embodiments, the apparatuses are configured to receive and couple to various medical accessories to facilitate oral administration of medical instruments, when needed. The description herein provides examples of the apparatus, systems, kits, and methods according to various non-limiting embodiments.

Figure 1B:
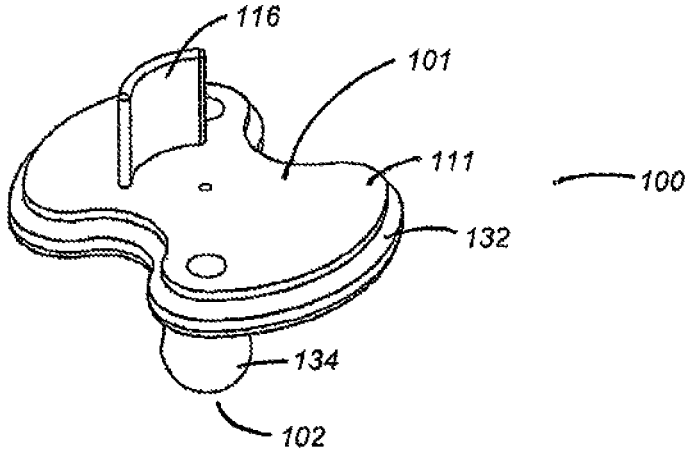
FIG. 1B depicts a perspective view of the embodiment illustrated in FIG. 1A.
Figure 1C:
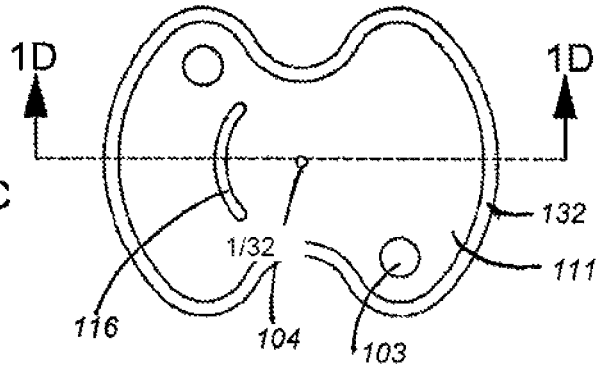
FIG. 1C depicts a distal view of the embodiment illustrated in FIG. 1A.
Figure 1D:
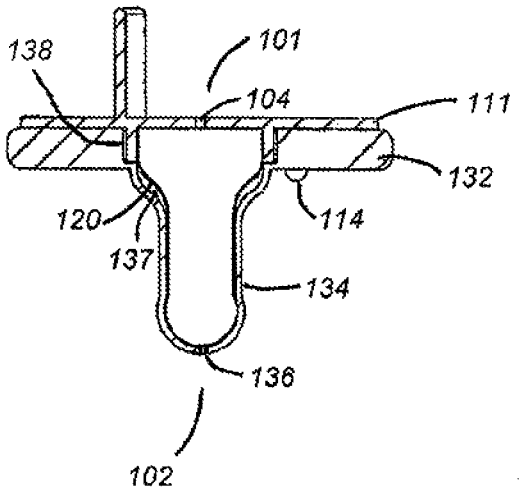
FIG. 1D depicts a cross-sectional view of the embodiment illustrated in FIG. 1A. The selected viewing angle of the cross-section is identified in FIG. 1C.

FIGS. 1A-1D illustrate a pacifier apparatus 100 in accordance with one embodiment of the present technology. FIG. 1A depicts an exploded side view of the embodiment, while FIG. 1B provides a perspective view, FIG. 1C provides a distal view, and FIG. 1D provides a cross-sectional view of the same embodiment. The apparatus 100 includes a rigid member assembly 110, a balloon 120, and a nipple assembly 130, as shown in the exploded view of FIG. 1A. The nipple assembly 130 of various embodiments includes a nipple base 132 and a nipple 134. The nipple base 132 as depicted includes a distal face 131 and a proximal face 133. The nipple 134 extends proximally from the proximal face 133 and includes a nipple wall 135 that defines a cavity 137 configured to hold fluid. The cavity 137 may be configured to hold any desired fluids, such as, for example, sucrose solutions and other analgesics, probiotic cultures, vitamins, nutritive solutions, colostrum, breast milk, antibiotics, anti-gas, over-the-counter medicaments, other liquid medicaments, and other fluids. The cavity 137 also may be configured to hold solution precursors, such as fluid-filled gel capsules and powders, which form a fluid solution upon exposure to the proper environmental trigger, such as, for example, heat and water, respectively.

In various embodiments, the nipple 134 is configured for sucking, such as within the mouth of a neonate or infant. As shown in FIGS. 1C and 1D, an air opening 104 is located at a distal end 101 of the apparatus 100. It should be understood that the air opening 104 can be located at any desirable location, not just the depicted location, and it can be of any suitable size and geometry. In some embodiments, the air opening 104 is configured to permit air or other gases to enter the chamber to prevent or minimize vacuum formation, wherein vacuum formation can prevent fluid from flowing out of the nipple aperture 136. The nipple aperture 136 is located at a proximal end 102 of the apparatus 100. In some embodiments, the configuration is designed to enable expulsion of fluid from the cavity 137 through the nipple aperture 136 and into the mouth of the neonate or infant, upon the nipple 134 being sucked. To facilitate sucking and fluid expulsion, in some embodiments, the nipple 134 is formed of a resilient and flexible material, including for example, one that is capable of non-permanent deformation. In one embodiment, the nipple 134 is formed of silicone. In other embodiments, the nipple 134 is formed of one or more of latex, plastic, rubber, another polymer, or a composite of polymers.

In some embodiments, the material characteristics of the nipple wall 135 and the size of the cavity 137 are carefully and purposefully selected. For example, in some embodiments, the cavity 137 is configured to hold a pre-determined volume of fluid. The cavity 137 can be configured to hold, for example, a recommended or desired dose of a medicament or fluid. The cavity 137 of some embodiments is sized to optimally hold, for example, 0.5-25 mL of fluid, or any individual value or sub-range therebetween. Additionally or alternatively, in some embodiments, the nipple size is tailored during the manufacturing process to comfortably fit within the average mouth size of a particular age group. Additionally, or in the alternative, in some embodiments, the thickness and flexibility of the nipple 134 and the size of the air opening 104 and the nipple aperture 136 are selected to form an apparatus 100 having a controlled flow rate of a predetermined value. As used herein, an apparatus can be said to have a controlled flow rate of a predetermined value if a fluid of a pre-selected viscosity flows from the nipple aperture 136 at a relatively steady average rate when subjected to a desired and constant rate of sucking, wherein each suck exerts a desired and constant force. For example, the size and material characteristics may be selected such that the apparatus 100 achieves an average flow rate that is most suitable for the fluid being administered, when the apparatus 100 is provided to an individual who sucks on the apparatus 100 with the same rate and force as an average child of an intended age group. The selected flow rate may be procedure-specific and/or age-specific, varying based on the fluid viscosity, recommended dose, and the average strength and rate of sucking performed by individuals in a target age group.

In one embodiment, such as the embodiment of FIGS. 1A-1D, the nipple 134 and nipple base 132 are integrally formed as a unitary body. In other embodiments, the nipple 134 and nipple base 132 are formed separately and fused or otherwise affixed together during the manufacturing or use process.

When the apparatus 100 is fully assembled, the balloon 120, depicted in FIG. 1A, can be located in a passage within the nipple base 132 and/or within the cavity 137. The balloon 120 of some embodiments is configured to transition from an undeployed or partially undeployed state to a deployed state or a nearly deployed state when the nipple 134 is sucked or squeezed. In a fully deployed state, the balloon 120 of some embodiments has an exterior size that is more or less the same size as the interior of the nipple wall 135. Thus, in the fully deployed state, the balloon 120 substantially lines the interior of the nipple wall 135. By transitioning towards a deployed state in response to the nipple 134 being sucked or squeezed, the deploying balloon 120 exerts force onto the fluid within the cavity 137, facilitating expulsion of the fluid from the cavity 137 through the nipple aperture 136. The directional force created by the balloon 120 filling into the cavity 137, guides fluid towards the nipple aperture 136 regardless of the angle of the apparatus 100 or the user of the apparatus. Therefore, in such embodiments, fluid can be administered to an infant or child situated in any position, for example from 0 to 180 degrees from horizontal, that is, from laying horizontally to sitting or even leaning forward. Furthermore, in the deployed state, the balloon 120 effectively can at least partially or completely line and seal the cavity 137, thereby preventing air from flowing from the air opening 104 through the nipple aperture 136. In this manner, the apparatus 100 can be configured to limit a user's ingestion of air. The balloon 120 of various embodiments is formed, for example, from one or more of the following: a balloon, a sock, a sleeve, a bag, and any other membrane configured to transition from a limp, substantially undeployed state to an expanded, substantially deployed state that substantially lines the interior of the nipple wall 135. In some embodiments, the balloon 120 is made of one or more of latex, low density polyethylene, other plastic or polymeric material, or any other suitable material. Moreover, while an apparatus having a balloon is described here and elsewhere in the specification, it should be understood that an appropriate equivalent to the balloon 120, and one contemplated here, is any element adapted to move proximally within the cavity 137 in response to negative pressure being created in the cavity from sucking and/or in response to positive pressure being exerted on the element from a distal direction, such as, for example when a pump (described in detail below) is actuated. As one illustrative example, a slideable solid material, such as a stopper or plunger, may be used to perform the same function as the balloon 120 described herein.

It should be understood that the term "substantially undeployed can mean that the device is not more than 30% deployed, preferably less than 20%, less than 10%, less than 5%, less than 3%, 2%, or 1% deployed, or any value or subrange therein. The term "substantially deployed" can mean for example, that the device is from about 60% to 99.9% (or even 100%) deployed or any sub-range or value there between, for example, preferable at least 70%, 80%, 90%, 95%, 96%, 97%, 98%, or 99% deployed. Furthermore, the term "substantially line" can mean that the device lines from 60%-100% of the interior of the nipple or any subrange or value there between, for example, at least 70%, 80%, 90%, 95%, 96%, 97%, 98%, or 99%.

As shown in FIG. 1D, the embodiment of FIG. 1 also may include a passage wall 138 that defines a passage extending through the nipple base 134 from the distal face 131 to the proximal face 133. In several embodiments, the passage may be centrally located in the nipple base 132 and axially aligned with a distal opening to the cavity 137. Such a configuration allows for the positioning of a rigid member 112 within the passage and the positioning of a mouth 122 of the balloon 120 around the rigid member 112 with the body 124 of the balloon 120 then able to extend into the cavity 137 of the nipple assembly 130.

In the depicted embodiment, the rigid member 112 (see, e.g., FIG. 1A) extends into the passage of the nipple base 132 is provided to secure the balloon mouth 122 in a fixed position relative to the nipple base 132. In some embodiments, a rigid member assembly 110 is also provided to help secure the rigid member 112, and ultimately, the balloon 120 relative to the nipple base 132. The rigid member assembly 110 can take many forms. In some embodiments, such as the one illustrated in FIG. 1A-1D, the rigid member 112 is integrally connected to, and extends proximally from, a rigid plate 111.

In some embodiments, the rigid plate 111 has a handle 116 extending distally from the rigid plate 111. Such a handle 116 as depicted is configured to extend away from a user's face when the apparatus 100 is positioned within a user's mouth in order to facilitate insertion and removal of the apparatus 100 by the user or the user's caregiver. The handle 116 also can be positioned in other locations and/or directions. In the embodiment of FIG. 1A-1D, the rigid plate 111 is positioned on the distal face 131 of the nipple base 132 and fixedly attached to the nipple base 132 through, at least, the use of one or more anchors 114. Such anchors 114 extend proximally from the rigid plate 111 through anchor holes located within the nipple base 132. The anchors may be in any desired configuration, for example, the depicted mushroom-shape, and they optionally can include threaded members having a screw head, or be of any other design that creates a secure connection between the nipple base 132 and the rigid member assembly 110. In addition or in the alternative, the anchors 114 may extend distally from the distal face 131 of the nipple base 132 through anchor holes located within the rigid plate 111. The anchors 114 may provide for a press fit, snap fit, screw fit, or any other desired connection.

Figure 2A:
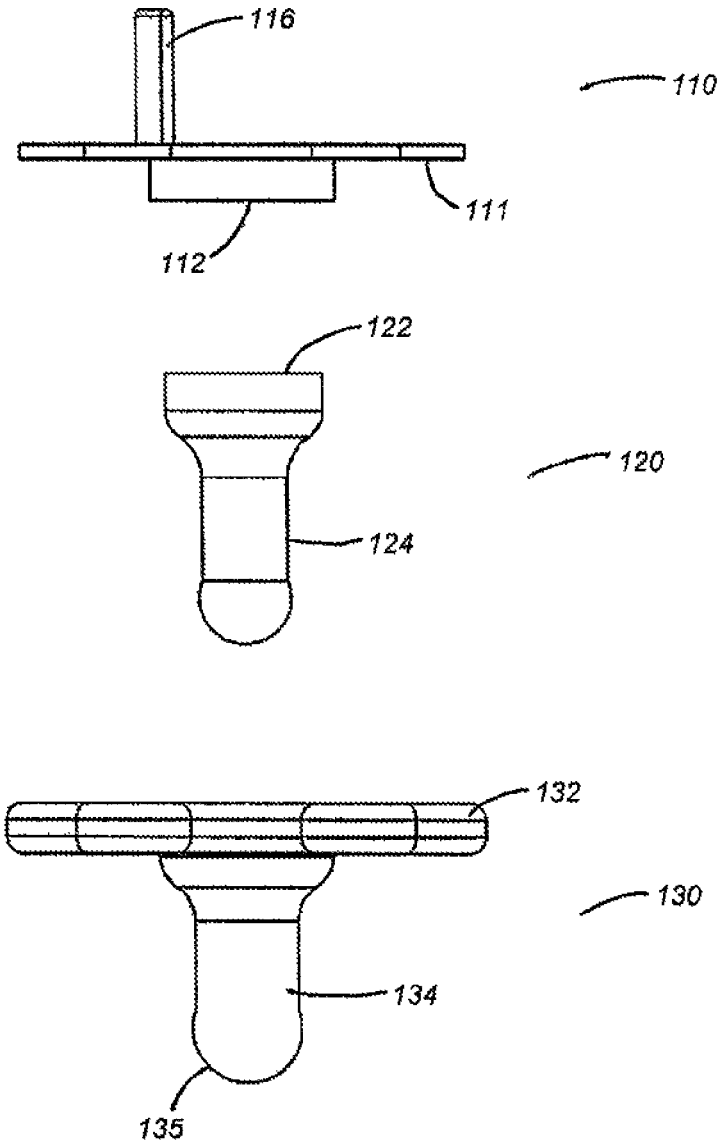
FIG. 2A depicts an exploded side view of a second embodiment of a pacifier apparatus configured for the oral administration of fluids. The exploded view includes depictions of a rigid member assembly, a balloon, and a nipple assembly.
Figure 2B:
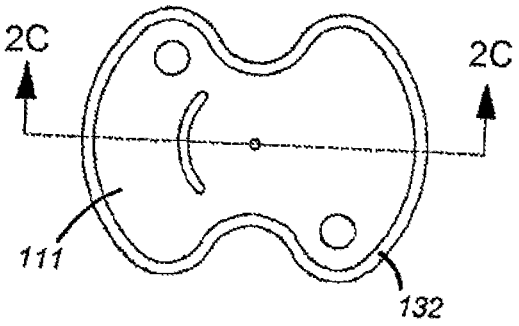
FIG. 2B depicts a distal view of the embodiment illustrated in FIG. 2A.
Figure 2C:
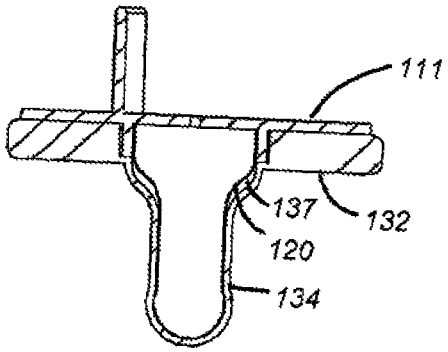
FIG. 2C depicts a cross-sectional view of the embodiment illustrated in FIG. 2A. The selected viewing angle of the cross-section is identified in FIG. 2B.
Figure 2D:
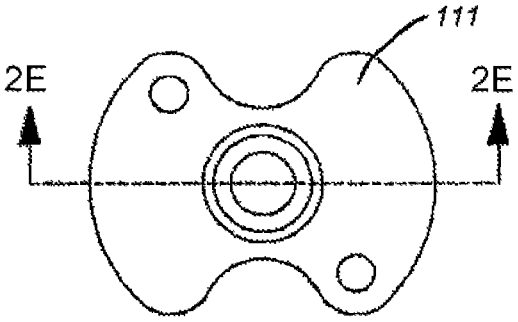
FIG. 2D depicts a distal view of one embodiment of a rigid member assembly with a balloon affixed to the rigid member assembly.
Figure 2E:
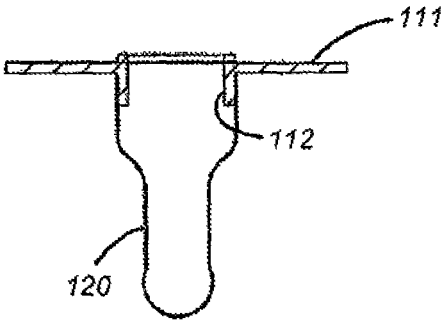
FIG. 2E depicts a cross-section of the rigid member assembly and the balloon illustrated in FIG. 2D.

In some embodiments, such as the apparatus embodiment depicted in the exploded view of FIG. 2A, no anchors are present. Anchors are not necessary, for example, if the rigid member 112 and balloon mouth 122 are secured relative to the nipple base 132 through other fixation means. As illustrated in FIGS. 2B and 2C, which respectively depict a distal view and cross-sectional view of the embodiment of FIG. 2A, the rigid member 112 and rigid plate 111 are secured to the nipple base 132 using another suitable or desired approach, for example, an interference fit, ultrasonic welding, use of a polymeric adhesive or other adhesive means, etc. Alternatively, in some embodiments, over-molding is used during the manufacturing process to secure at least a portion of the rigid member assembly 110 within the nipple base 132. Similarly, as shown in the distal view and cross-sectional view of a balloon 120 coupled to a rigid member assembly 110, provided in FIGS. 2D and 2E, respectively, the balloon 120 may be affixed to the rigid member 112 using any suitable fixation means. For example, in some embodiments, an industrial-strength adhesive or ultrasonic welding is used to secure the balloon.

In some embodiments, such as the ones illustrated in the perspective views of FIGS. 3A, 3B, and 4A, the apparatus includes at least a nipple 134 and a nipple base 132, as described above, and additionally, a pump 141. The pump 141 serves as a primary or secondary mechanism for expelling fluid from the cavity 137 through the nipple aperture 136. The pump 141 also can serve as a primary or secondary mechanism for deploying the balloon 120, when such a balloon is present. It may be advantageous to provide a pump 141 on the distal end of the apparatus 100 to enable a caregiver to facilitate expulsion of the fluid. Such an embodiment may be particularly advantageous for administering fluid to premature neonates or others who cannot or are not sucking adequately. This configuration may also be advantageous during some procedures in which it is desirable to provide both light, fairly continuous flows of fluid, as is expressed during sucking, and larger aliquots of fluid administered at spaced intervals. In some embodiments, the apparatus with a pump is configured to provide metered (i.e., measured) doses of fluid. This configuration may be particularly advantageous in medical settings and other settings where a medicament is provided, as it is often extremely important to monitor the amount of medicament ingested. In some embodiments, the apparatus can expel a pre-measured amount, optionally at a measured flow rate. For example, in some embodiments, the apparatus is prefilled with a given amount or dosage of a fluid or product. During use of some such embodiments, the entire amount of pre-measured fluid or product may be expelled. In some such embodiments, the apparatus is configured to measure the amount of fluid expelled, such as for example, in instances where less than the total fluid in the apparatus is expelled. As an illustrative example, the apparatus may arrive filled with 5 mL of a fluid, but it may be desired that, for a particular infant, treatment, or procedure, only 3 mL be expelled. The apparatus of some embodiments is configured to provide a measurement of the expelled amount. For example, the apparatus of some embodiments includes measurement lines, such as, for example, the measurement lines 146 on the nipple 134 or on a syringe body 143, which can be numbered and spaced to indicate the amount of fluid in, or expelled from, the device.

FIGS. 3A, 3B, and 4A provide examples of pacifier apparatuses 100 having pumps 140, for illustrative purposes only. The pump 141 of various embodiments may take any suitable, actuateable shape; for instance, as non-limiting examples, the pump may be bulbous, cylindrical, formed as a polyhedron, formed as a plunger, or formed as a syringe. Additionally, the pump 141 of various embodiments may be actuated in any desired way, for example, it can be compressible, depressible, and/or squeezable or can include any other appropriate pumping mechanism. In some embodiments, the pump 141 has an opening 104 positioned on a wall of the pump 141; the opening 104 may be accompanied with ribs, grooves, concave or convex features, or any other form adapted to facilitate user identification of the location of the opening 104. The opening 104 of some embodiments is formed as a hole, slit, valve, or any other shape which enables the flow of air into an interior of the pump 141. As an example, the pump 141 in FIGS. 3A and 4A can be actuated by covering the opening 104 with a finger, squeezing the pump 141 to move the pump walls closer together and to thereby move at least some existing air from the pump into the balloon, and releasing or uncovering the opening 104 to allow air inflow, which enables the pump 141 to return to its initial size and state. In other embodiments, the pump 141 may be actuated by pushing down on a rigid and slideable, or non-rigid, top portion of the pump 141. For example, in FIG. 3B, the pump (i.e., syringe) 141 can be actuated by depressing the plunger 144 down at least partially into a syringe body 143. Using a pump formed as a syringe, such as, for example, the syringe 141 of FIG. 3B, may advantageously allow a caregiver to monitor the amount of fluid dispelled during use of the apparatus. For example, even though air rather than fluid is present in the syringe body 143 of various embodiments, a measured depression of the plunger 144 causes movement of air from the syringe body 143 into the balloon or nipple cavity, which translates into a comparable or nearly comparable level of fluid expulsion from the nipple cavity through the nipple aperture 136.

Figure 4C:
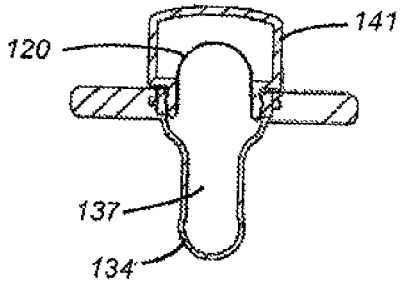
FIG. 4C depicts a cross-sectional view of the embodiment illustrated in FIG. 4A with a balloon in an undeployed state. The selected viewing angle of the cross-section is identified in FIG. 4B.
Figure 4B:
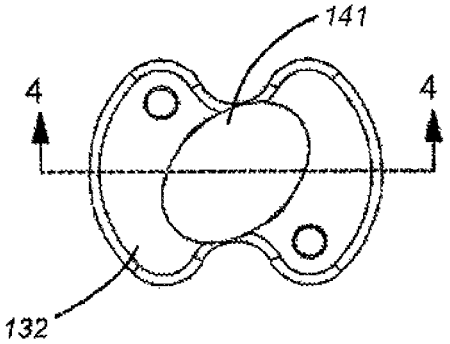
FIG. 4B depicts a distal view of the embodiment illustrated in FIG. 4A.

FIG. 4B provides a distal view of the pacifier apparatus 100, including the pump 141, depicted in FIG. 4A. The pump 141 extends from the distal side of the apparatus such that a caregiver can easily reach and actuate the pump 141 to express fluid through the nipple aperture 136.

Figure 4D:
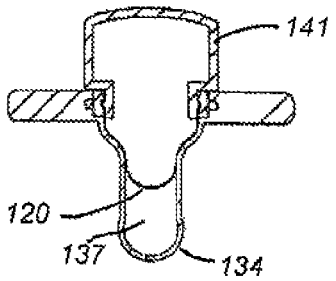
FIG. 4D depicts a cross-sectional view of the embodiment illustrated in FIG. 4A with a balloon in a semi-deployed state. The selected viewing angle of the cross-section is identified in FIG. 4B.
Figure 4E:
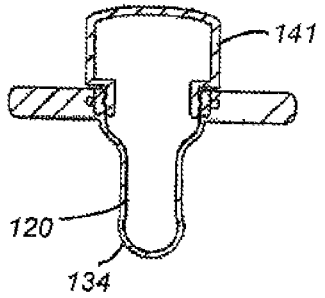
FIG. 4E depicts a cross-sectional view of the embodiment illustrated in FIG. 4A with a balloon in a fully deployed state. The selected viewing angle of the cross-section is identified in FIG. 4B.

FIGS. 4C-4E provide a cross-sectional view of the embodiment of FIGS. 4A and 4B. Each of FIGS. 4C-4E depicts the same cross-sectional area and is provided to illustrate a balloon 120 transitioning from an undeployed (or substantially undeployed) state to a deployed (or substantially deployed) state. As shown in FIG. 4C, in the undeployed state, the balloon 120 is limp and substantially retracted toward or into the passage or pump 141. The depiction is not meant to be limiting; the balloon could be in any orientation, for example, compacted in the same plane as the base 132, etc. In response to the nipple 134 being sucked and/or the pump 141 being actuated, an undeployed balloon 120 will begin to transition toward a deployed state. A non-limiting depiction of a partially deployed balloon 120 is illustrated in FIG. 4D. As shown in the figure, when in a partially deployed state, the balloon 120 partially enters the nipple cavity 137. FIG. 4E provides an illustration of a fully deployed balloon 120. As visible in the illustration, in the fully deployed state, the balloon 120 is relatively comparable to the nipple wall 135 in size and shape. In such a state, the balloon 120 substantially lines an inner perimeter of the nipple wall 135.

Figure 5A:
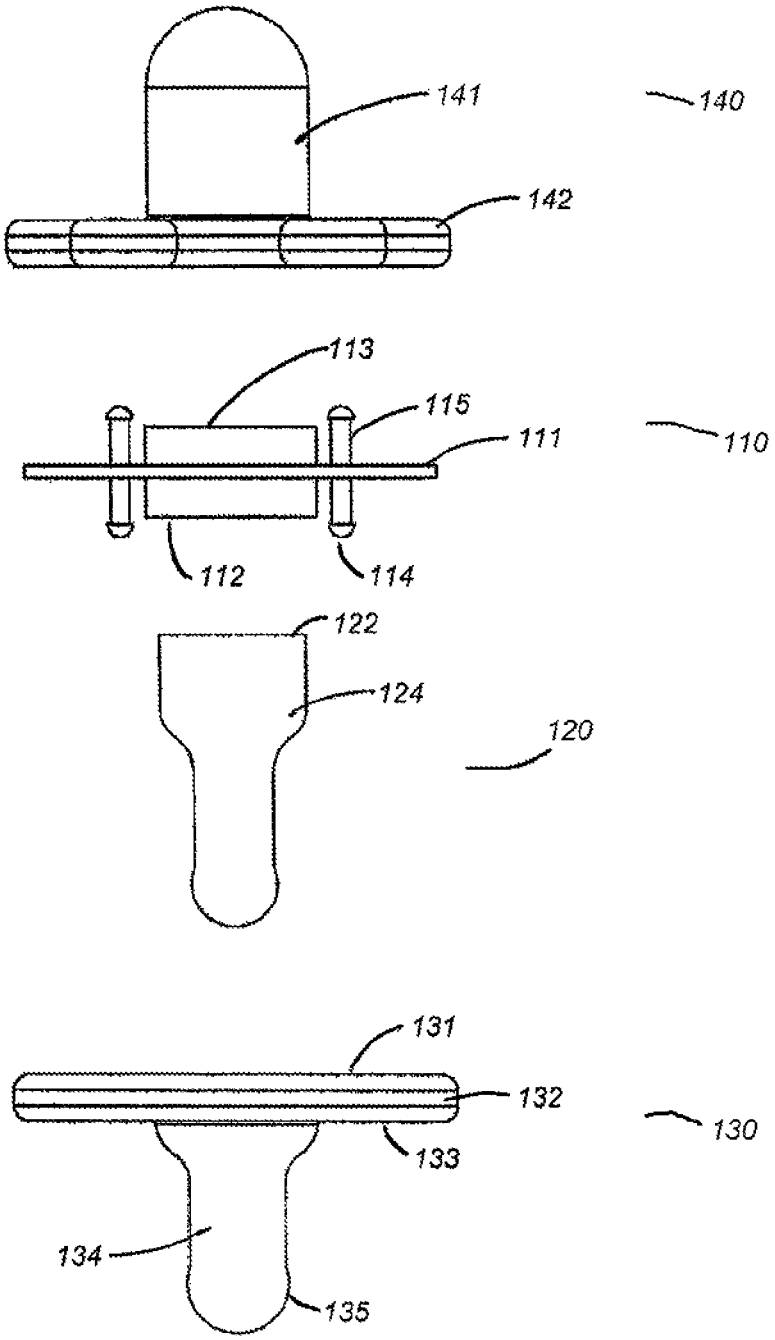
FIG. 5A depicts an exploded side view of another embodiment of a pacifier apparatus configured for the oral administration of fluids.
Figure 5B:
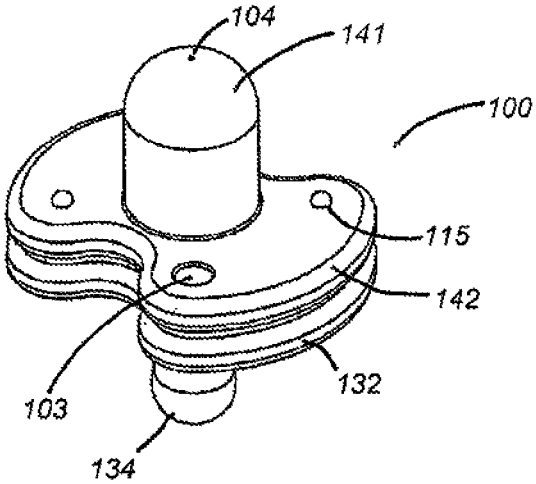
FIG. 5B depicts a perspective view of the embodiment illustrated in FIG. 5A.
Figure 5C:
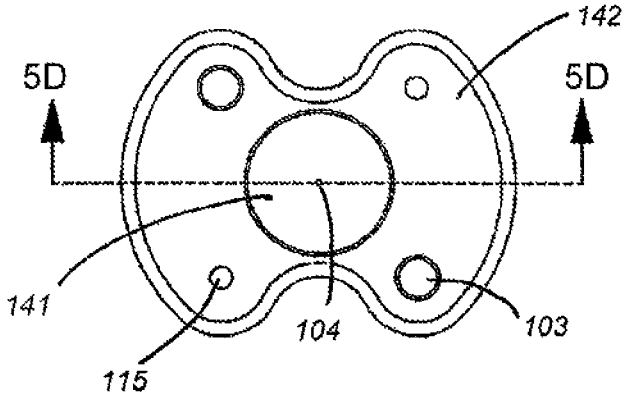
FIG. 5C depicts a distal view of the embodiment illustrated in FIG. 5A.
Figure 5D:
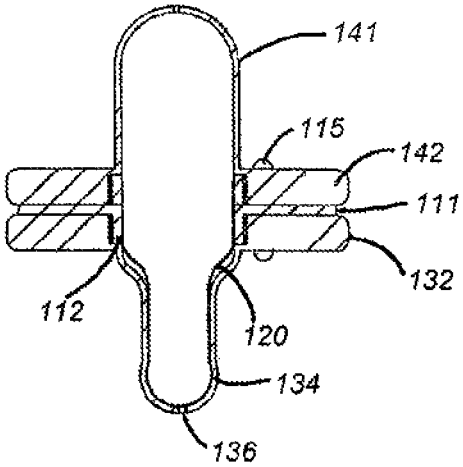
FIG. 5D depicts a cross-sectional view of the embodiment illustrated in FIG. 5A. The selected viewing angle of the cross-section is identified in FIG. 5C.

As with the non-limiting pump-less embodiments described above, in the embodiments that include a pump, there are numerous mechanisms for affixing or joining the various components together. Some embodiments that include a pump 141 also include a rigid member 112 designed to fixedly secure the balloon mouth 122 relative to the nipple assembly 130. It should be understood that the rigid member can be a separate member or integral with some other component. In any case, the rigid member 112 is a component to which the balloon 120 can be attached in some embodiments. As illustrated in FIG. 5A, the rigid member 112 of some embodiments is integrated into a rigid plate 111. FIG. 5A depicts an exploded view of one embodiment of a pacifier apparatus 100 having a pump 141. FIGS. 5B, 5C, and 5D depict the same embodiment through a perspective view, distal view, and cross-sectional view, respectively. In some embodiments, such as the one of FIGS. 5A-5D, a second rigid member 113 is coupled to the rigid plate 111 such that one rigid member 113 extends distally and one rigid member 112 extends proximally from the rigid plate. Additionally, in some embodiments, such as the one of FIGS. 5A-5D, the apparatus 100 further includes a pump base 142. When present, the pump base 142 contains one or more through-holes 103 to allow for the passage of air from a distal side of the pump base 142 to a proximal side. Such through-holes 103 are also located in the nipple base 132 and the rigid plate 111, when present in the apparatus 100. The through-holes 103 in each element are positioned such that the through-holes of the various elements align and allow for the passage of air from a proximal side of the apparatus 100 to a distal side of the apparatus. The through-holes can function as a safety feature, helping to ensure that a child does not suffocate should the apparatus 100 become engulfed in the child's mouth or lodged in the child's airway. The pump as depicted in FIGS. 5 and 6 can be actuated for example by applying force or pressure to the pump 141 in the direction toward the base 142, for example, while covering the hole 104. Upon uncovering the hole 104, the pump can return to its original position and can then be actuated again if desired.

The pump base 142 of some embodiments is integrally connected with a proximal end of the pump 141. In the embodiment of FIGS. 5A-5D, one rigid member 113 is positioned within a passage that extends through the pump base 142 and the other rigid member 112 is positioned within the passage that extends through the nipple base 132. The nipple assembly 130, rigid member assembly 110, and pump assembly 140 are fixedly connected, for example, through the use of anchors 114, 115, some of which extend from a proximal face of the rigid plate 111 through holes located in the pump base 142 and some of which extend from a distal face of the rigid plate 111 through holes located in the nipple base 132. In other embodiments, other means of connection may be used.

Figure 6A:
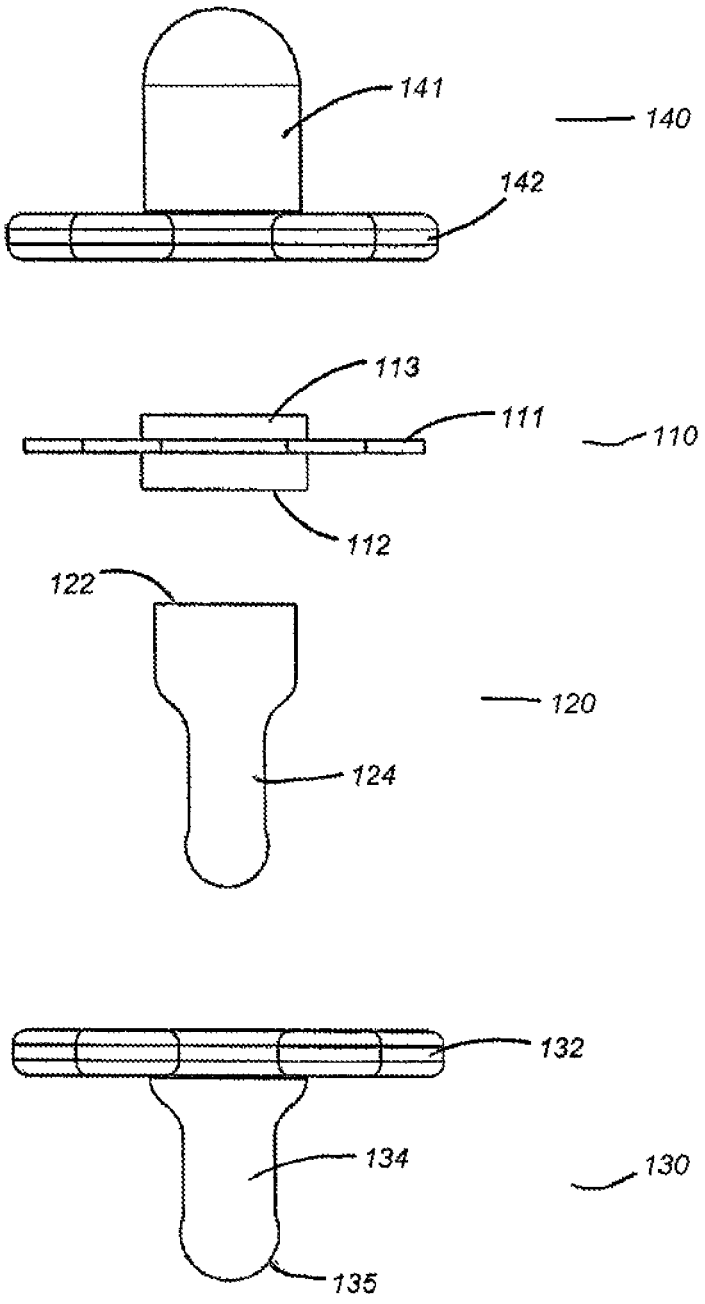
FIG. 6A depicts an exploded side view of another embodiment of a pacifier apparatus configured for the oral administration of fluids.
Figure 6B:
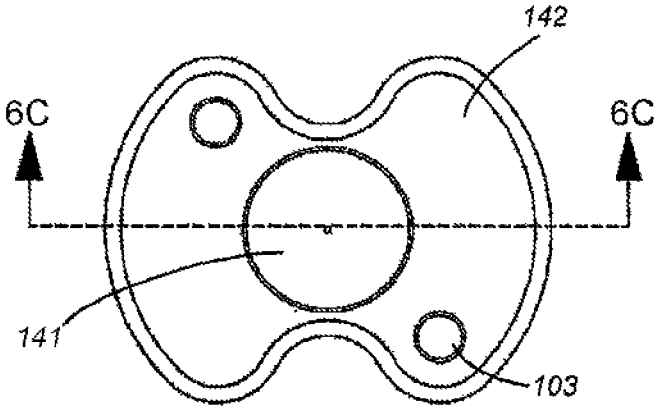
FIG. 6B depicts a distal view of the embodiment illustrated in FIG. 6A.
Figure 6C:
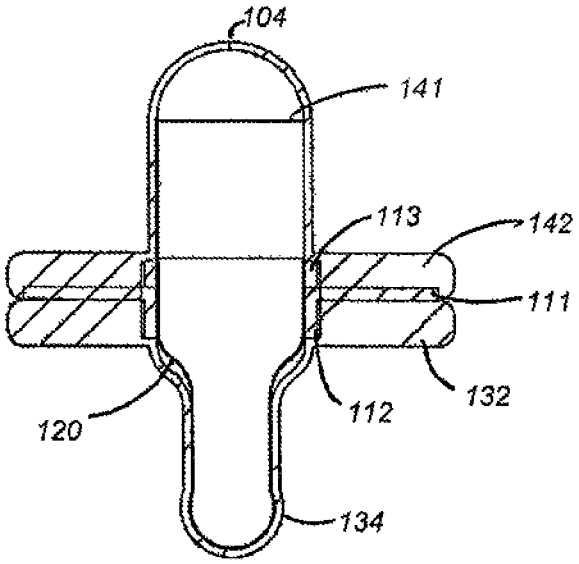
FIG. 6C depicts a cross-sectional view of the embodiment illustrated in FIG. 6A. The selected viewing angle of the cross-section is identified in FIG. 6B.

FIGS. 6A-6C illustrate another embodiment of a pacifier apparatus 100 configured for the oral administration of fluid, which includes a pump 141. FIG. 6A provides an exploded view of the pump assembly 140, rigid member assembly 110, balloon 120, and nipple assembly 130, while FIGS. 6B and 6C provide a distal view and cross-sectional view, respectively, of the fully assembled apparatus 100. The apparatus 100 of FIG. 6A includes a pump 141, which can be actuated, for example, by applying force or pressure to the pump 141 toward to the base 142 while covering the aperture 104. Additionally or alternatively, the force can be provided by squeezing the pump 141 body to apply side or lateral pressure/force to the pump. In this illustrated embodiment, the rigid plate 111 of the rigid member assembly 110 lacks any anchors. Thus, the rigid plate 111 may be affixed to the pump assembly 140 and nipple assembly 130 by applying an industrial strength adhesive, performing ultrasonic welding, using over-molding, or through any other suitable fixation method.

Figure 7A:
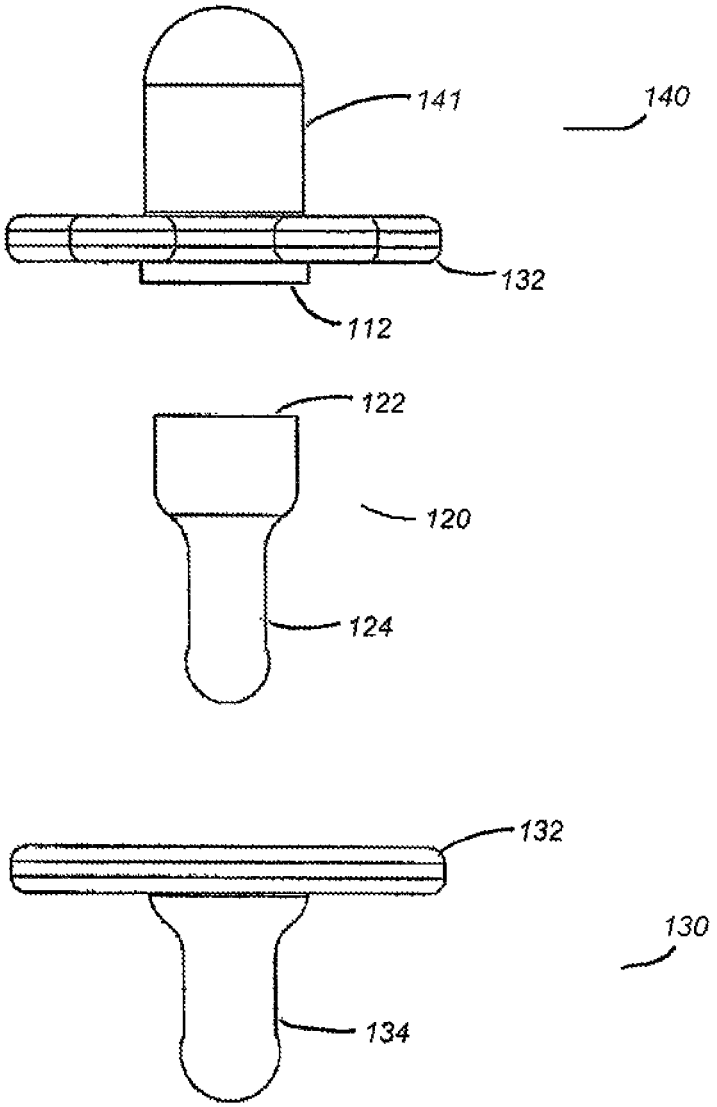
FIG. 7A depicts an exploded side view of another embodiment of a pacifier apparatus configured for the oral administration of fluids.
Figure 7B:
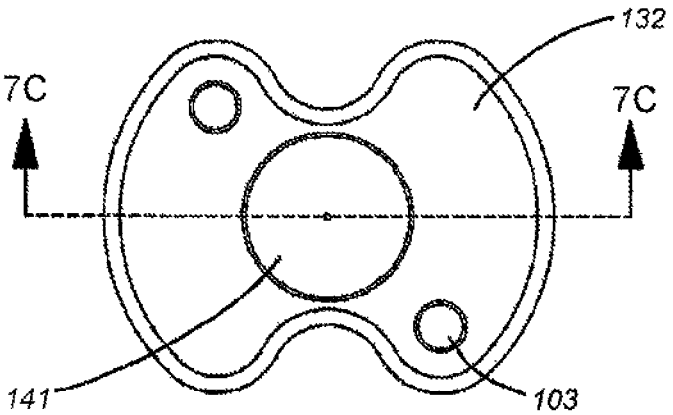
FIG. 7B depicts a distal view of the embodiment illustrated in FIG. 7A.
Figure 7C:
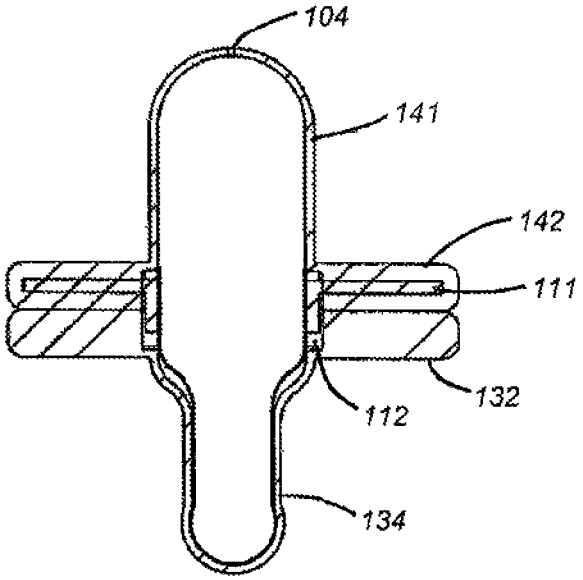
FIG. 7C depicts a cross-sectional view of the embodiment illustrated in FIG. 7A. The selected viewing angle of the cross-section is identified in FIG. 7B.
Figure 8A:
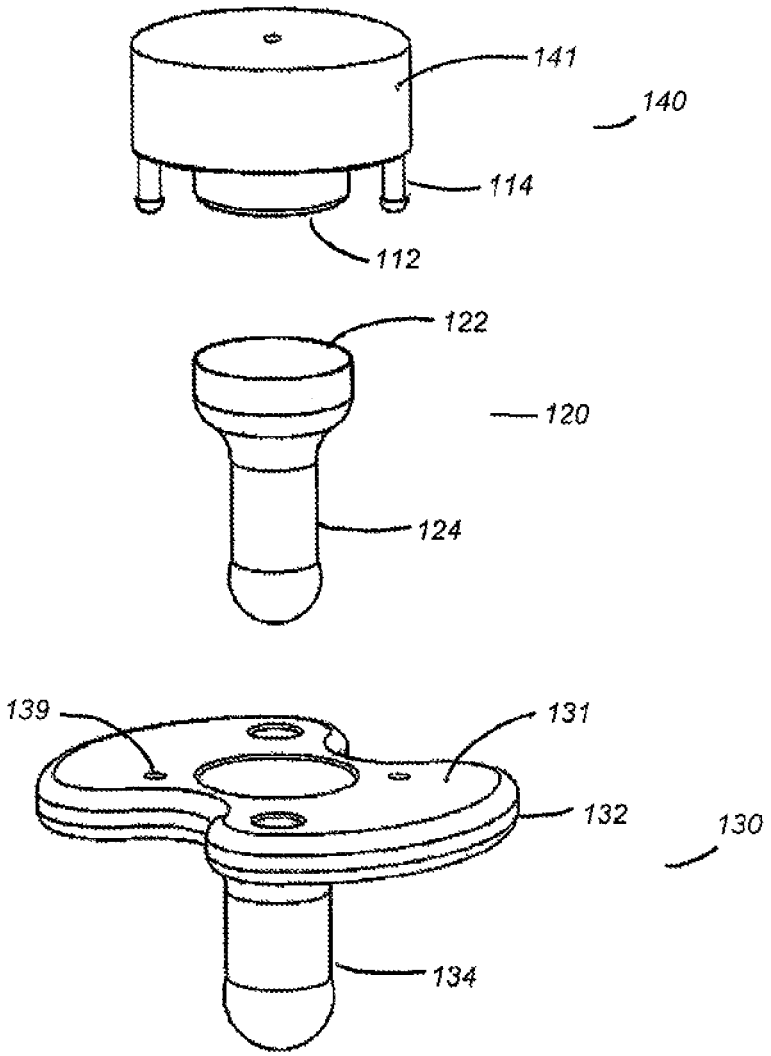
FIG. 8A depicts an exploded side view of another embodiment of a pacifier apparatus configured for the oral administration of fluids.
Figure 8B:
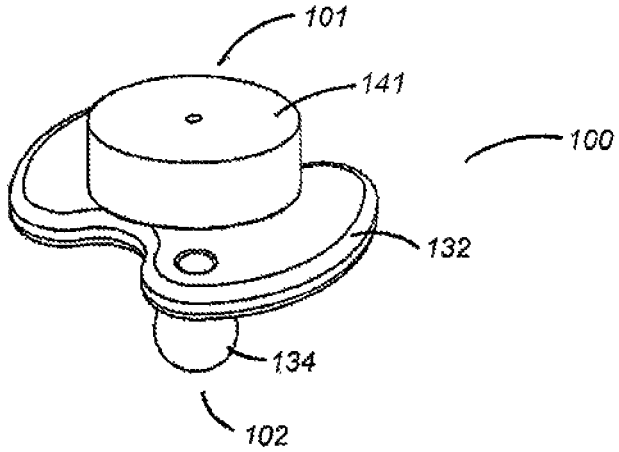
FIG. 8B depicts a perspective view of the embodiment illustrated in FIG. 8A.
Figure 8C:
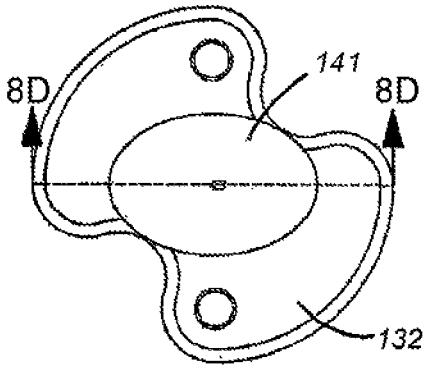
FIG. 8C depicts a distal view of the embodiment illustrated in FIG. 8A.
Figure 8D:
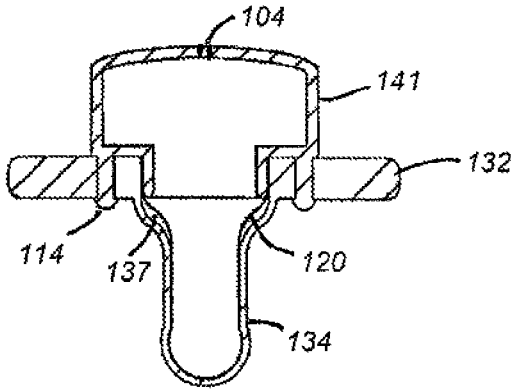
FIG. 8D depicts a cross-sectional view of the embodiment illustrated in FIG. 8A. The selected viewing angle of the cross-section is identified in FIG. 8C.

In some embodiments of the pacifier apparatus 100, such as the one illustrated in FIGS. 7A-7C, the rigid member 112 extends proximally from the pump base 142. Such a configuration may be present in designs where the rigid plate 111 is built or over-molded into the pump base 142. Such a design is most visible in FIG. 7C. Such a configuration may also be present in designs in which the rigid member 112 is integrally connected and formed with the pump base 142. In such embodiments, the balloon 120 is affixed to the rigid member 112, the rigid member 112 is affixed into the passage of the nipple base 132, and the pump base 142 is directly coupled to the nipple base 132. Previously mentioned fixation methods or any other suitable forms of fixation may be used. In some embodiments, the coupling of the nipple base 132 and pump base 142 is reinforced with the addition of anchors. The anchors may extend proximally from the pump base 142 for insertion through holes within the nipple base 132. Additionally or in the alternative, anchors may extend distally from the nipple base 132 through holes within the pump base 142. Similar to the apparatus 100 of FIG. 6A, the apparatus 100 of FIG. 7 includes a pump 141, which can be actuated by applying force to the pump 141. The force can be applied by squeezing the sides together or by applying pressure toward the base in a proximal direction. If present, the aperture 104 can be covered in order to create pressure within the device.

FIGS. 8A-8D illustrate an embodiment of a pacifier apparatus 100 having a modified pump assembly 140. The pump assembly 140 of the depicted embodiment includes no pump base; instead, the rigid member 112 and anchors 114 extend directly from a proximal side of the pump 141. In such an embodiment, the pump assembly 140 is securely fastened to the nipple assembly 130 by affixing the rigid member 112 to the passage wall of the nipple base 132 and by inserting the anchors 114 into anchor holes 139 in the nipple base 132. In other embodiments, the anchors 114 may extend distally from the nipple base 132 for insertion into the pump 141. The pump 141 of FIGS. 8A-8D can be actuated, for example, by applying pressure or force to the pump 141. The optional aperture 104, if present, can be covered to allow internal pressure to be generated when the pump is pressed or squeezed, as desired.

Figure 9A:
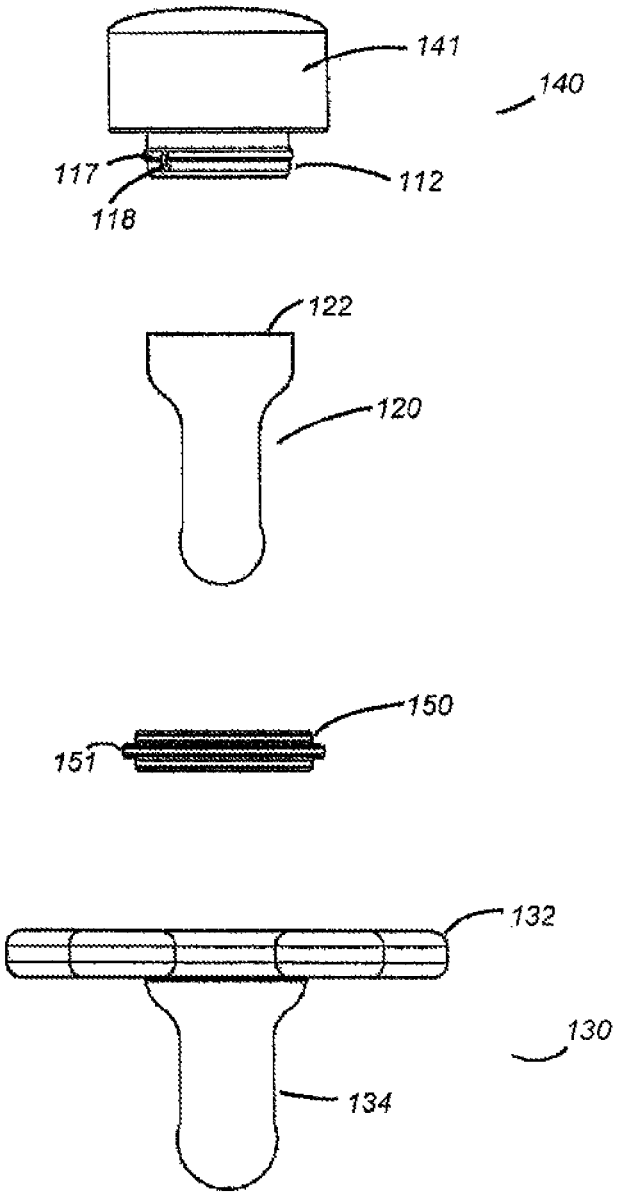
FIG. 9A depicts an exploded side view of another embodiment of a pacifier apparatus configured for the oral administration of fluids.
Figure 9B:
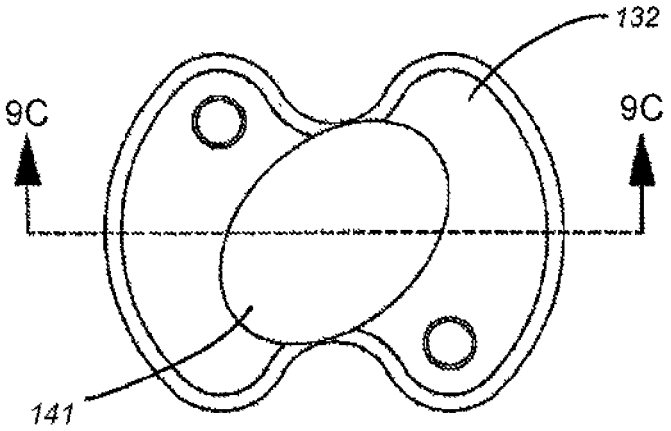
FIG. 9B depicts a distal view of the embodiment illustrated in FIG. 9A.
Figure 9C:
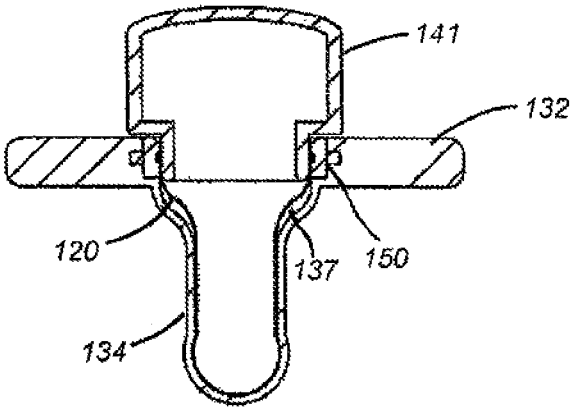
FIG. 9C depicts a cross-sectional view of the embodiment illustrated in FIG. 9A. The selected viewing angle of the cross-section is identified in FIG. 9B.

An additional or alternative attachment mechanism is illustrated in the embodiment of FIGS. 9A-9C. As shown in the exploded view of FIG. 9A, a locking ring 150 is provided to reinforce attachment of the balloon 120 and rigid member 112 to the nipple base 132. FIG. 9B provides a distal view of the same embodiment. In this embodiment, the balloon mouth 122 is positioned so as to engulf an outer perimeter of at least a proximal portion of the rigid member 112. In an alternate embodiment, the balloon mouth 122 is affixed to an inner perimeter of a rigid member 112. In either embodiment, the locking ring 150 is positioned around the rigid member 112. The locking ring 150 may be positioned around a distal portion of the rigid member 112, around the entire rigid member 112, or around the balloon mouth 122 at a proximal portion of the rigid member 112. The locking ring 150 is also securely attached to the nipple base 132 within the passage. In some embodiments, the locking ring 150 is integrally incorporated into the nipple assembly 130, for example, in embodiments in which over-molding is used in the manufacturing process to build the nipple base 132 around the locking ring 150.

As is visible in FIG. 9A and the cross-sectional view of FIG. 9C, in some embodiments, one of the rigid member 112 or locking ring 150 includes a groove, depression, indentation, or other recess (e.g., 117) while the other of said rigid member 112 or locking ring 150 includes a ridge, ledge, protrusion or the like (e.g., 151) configured to fit within the recess 117 in order to restrict movement of the rigid member 112 and balloon 120 in the distal and proximal directions. In addition or in the alternative, one of the rigid member 112 or locking ring 120 includes one or more tabs, teeth, or other protrusions (e.g., 118) while the other of said rigid member 112 or locking ring 150 includes one or more slots or depressions each configured to receive a protrusion 118. Such a feature may be included to limit the rotational movement of the rigid member 112 and balloon 120 relative to the nipple assembly 130. In some embodiments, the rigid member 112 may be snapped or pressed into fixed engagement with the locking ring 150. In other embodiments, the rigid member 112 and locking ring 150 may include complementary threading such that the rigid member 112 can be screwed into fixed engagement with the locking ring 150. The pump 141 can be actuated as described elsewhere herein.

Figure 10A:
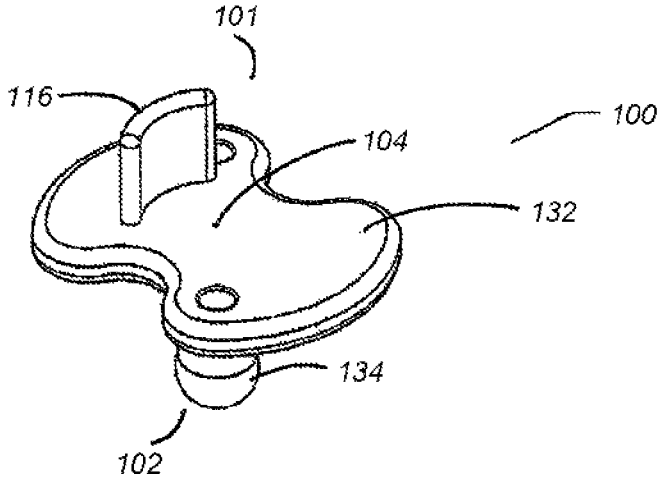
FIG. 10A depicts a perspective view of another embodiment of a pacifier apparatus configured for the oral administration of fluids.
Figure 10B:
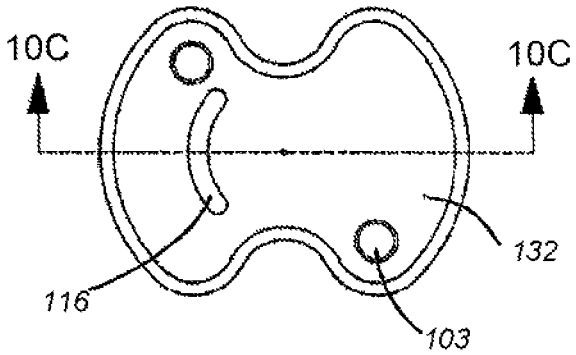
FIG. 10B depicts a distal view of the embodiment illustrated in FIG. 10A.
Figure 10C:
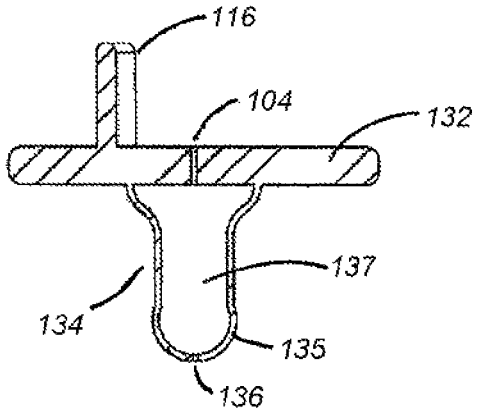
FIG. 10C depicts a cross-sectional view of the embodiment illustrated in FIG. 10A. The selected viewing angle of the cross-section is identified in FIG. 10B.

FIGS. 10A-10C illustrate an additional embodiment of a pacifier apparatus 100 configured for the oral administration of fluid. As best shown in the cross-sectional view of FIG. 10C, no attachment mechanisms are needed, because the apparatus 100 includes an integral, unitary body. For example, the apparatus can be made or manufactured by molding or any other suitable method to make such a unitary and/or integral apparatus. A perspective view and a distal view of this unitary body design are provided in FIGS. 10A and 10B, respectively. As is true for above-mentioned embodiments, the present embodiment includes, at least, a nipple 134, a nipple base 132, and a cavity 137 configured to hold fluid. In this embodiment, the cavity 137 is defined by both a nipple wall 135 and a portion of a proximal face 131 of the nipple base 132, wherein said portion is enclosed by the nipple wall 135. The cavity 137 of some embodiments is closed but for a nipple aperture 136 on a proximal tip of the nipple 134 and an optional opening 104 on a distal end of the cavity 137 which extends through the nipple base 132. The opening 104, if present, is configured to allow for the passage of air into the cavity 137 to enable sucking and/or to prevent the nipple wall 135 from collapsing.

In some embodiments, the opening 104 is in the form of a small pinhole or a slit. In some embodiments, the opening 104 includes a valve. In other embodiments, the opening 104 includes a frangible seal configured to seal fluid within the cavity 137 until the seal is ruptured just prior to use. The opening 104 may include any other form of hole or passage which is small enough to limit fluid from leaking from the opening during shipping and large enough to allow for sufficient passage of air. The opening 104 may be covered with a sticker or other removable seal to prevent fluid from spilling from the cavity during shipping. Such features of the optional opening 104 may be present in any of the pacifier apparatus embodiments and Figures described herein.

In various embodiments of the unitary apparatus, the size of the opening 104 and the size of the nipple aperture 136, as well as the size of the cavity 137 and the thickness of the nipple wall 135 may be selected so that the apparatus 100 achieves a desired cavity pressure and a desired average flow rate when sucked on by an individual with an average sucking force and sucking rate equal to the average sucking force and sucking rate expected within the age group for which the apparatus 100 is tailored.

In some embodiments, such as the embodiment of FIGS. 10A-10C, the apparatus has no removable parts. Such a pacifier apparatus 100, which is capable of controlled flow while also having a unitary body design, may provide some advantages. The embodiment of FIGS. 10A-10C is simple to manufacture, is low cost, and lacks potentially separable and therefore potentially hazardous parts. In some embodiments, such as the one depicted in FIGS. 10A-10C, an optional handle 116 extends from the distal face 131 of the nipple base 132. The handle 116 also may be part of the unitary body design.

Figure 11A:
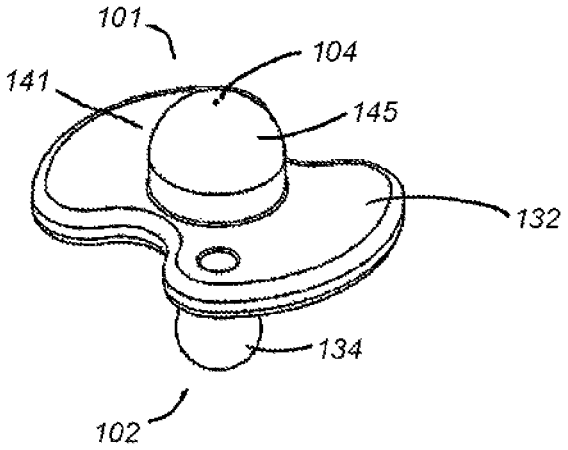
FIG. 11A depicts a perspective view of another embodiment of a pacifier apparatus configured for the oral administration of fluids.
Figure 11B:
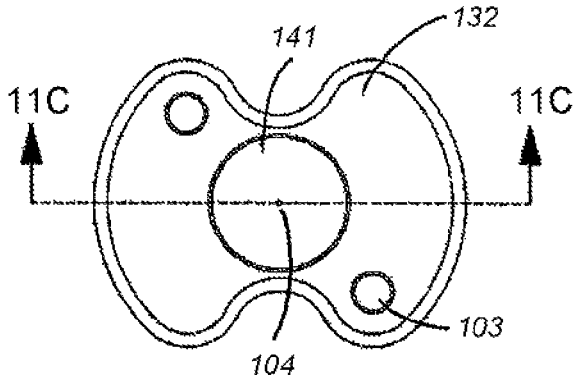
FIG. 11B depicts a distal view of the embodiment illustrated in FIG. 11A.
Figure 11C:
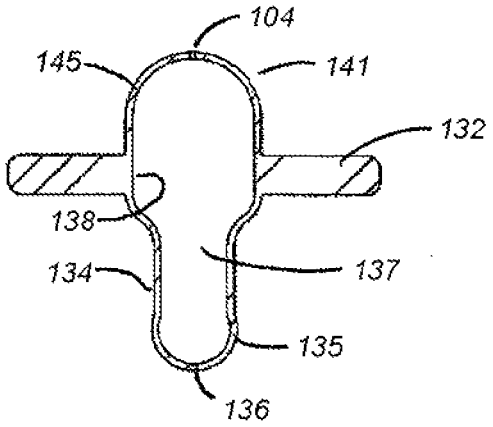
FIG. 11C depicts a cross-sectional view of the embodiment illustrated in FIG. 11A. The selected viewing angle of the cross-section is identified in FIG. 11B.
Figure 12A:
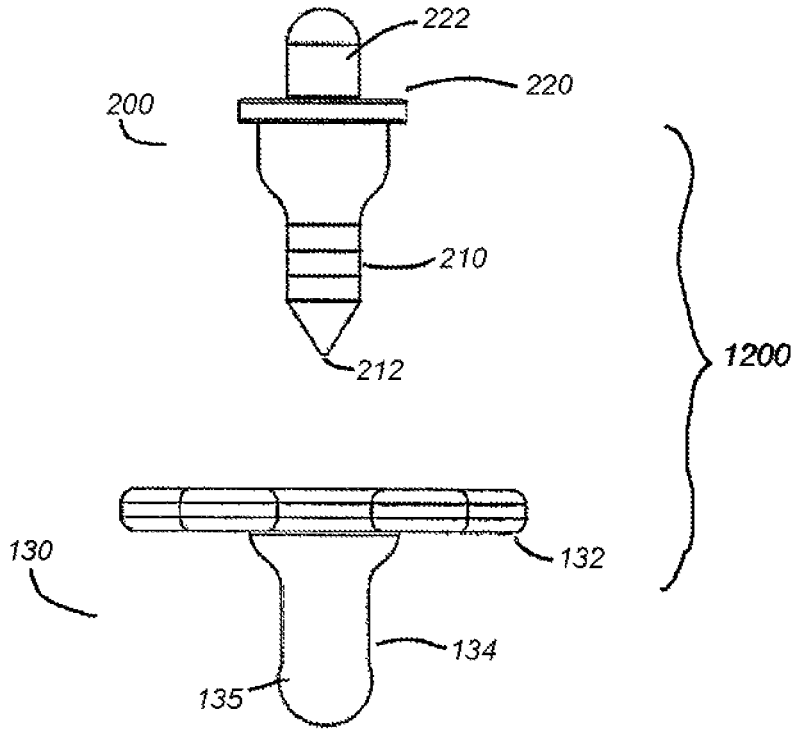
FIG. 12A depicts an exploded side view of an embodiment of a pacifier system configured for the oral administration of fluids.
Figure 12B:
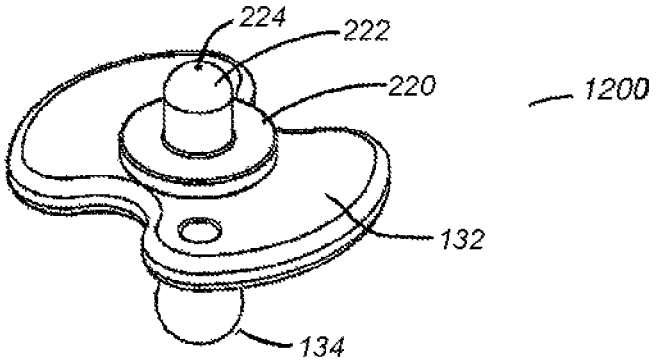
FIG. 12B depicts a perspective view of the embodiment illustrated in FIG. 12A.
Figure 12C:
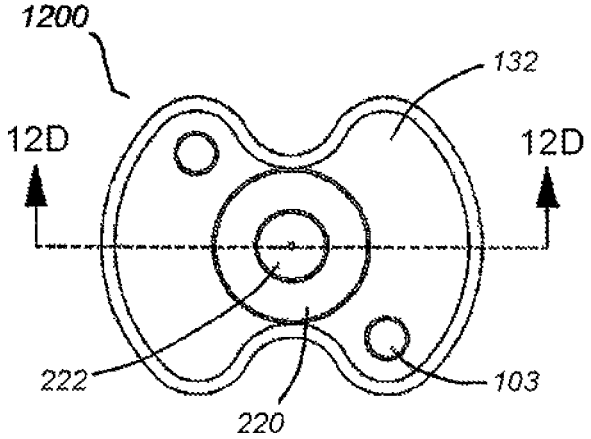
FIG. 12C depicts a distal view of the embodiment illustrated in FIG. 12A.
Figure 12D:
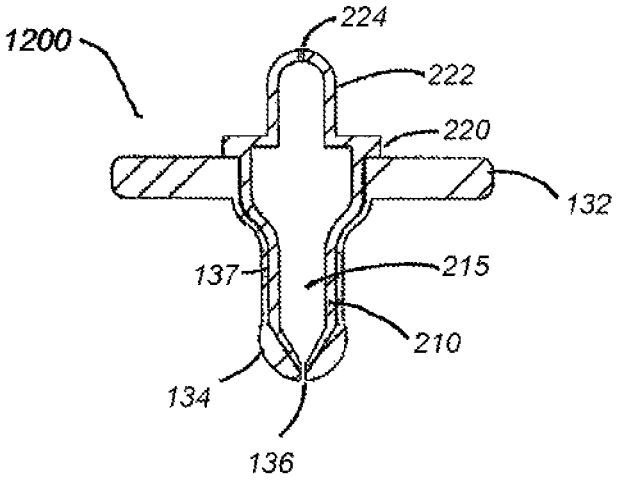
FIG. 12D depicts a cross-sectional view of the embodiment illustrated in FIG. 12A. The selected viewing angle of the cross-section is identified in FIG. 12C.

In other embodiments of a pacifier apparatus 100 having a unitary design, such as the embodiment of FIGS. 11A-11C, a pump 141 extends from the distal face 131 of the nipple base 132. The pump of some embodiments includes one or more compressible walls 145. As visible in the cross-sectional view of FIG. 11C, in some embodiments having a unitary body with a pump 141, the nipple wall 135 and compressible wall 145 each connect to a passage wall 138 in the nipple base 132, and together, the nipple wall 135, the compressible wall 145, and the passage wall 138 define the cavity 137. In some embodiments, the cavity 137 may constrict at the location of the nipple base 132. As in above-mentioned embodiments of an apparatus 100 having a pump 141, in the embodiment of FIGS. 11A-11C, fluid can be expelled from a nipple aperture 136 at a proximal end of the nipple 134 by sucking or squeezing the nipple 134 and/or by compressing, depressing, or otherwise squeezing the pump 141. The apparatus 100 having a unitary body may be formed of any suitable material, for example, one or more of silicone, plastic, rubber, or other polymer, composite, or material that is safe for children and non-permanently deformable.

An embodiment of a pacifier system is depicted in FIGS. 12A-12D. As shown in the exploded view of FIG. 12A, the pacifier system 1200 of the current embodiment includes: a pacifier apparatus in the form of a nipple assembly 130, and an insertable cartridge 200. The nipple assembly 130 includes a nipple 134 and a nipple base 132. The nipple 134 extends proximally from the nipple base 132 and includes a nipple wall 135, which defines the perimeter of a nipple cavity 137. In some embodiments, the nipple wall 135 has one or more thickened or contoured regions, for example, to create a nipple cavity 137 that is complementary in size and shape to the cartridge 200, which the nipple assembly 130 is configured to receive. A passage extends through the nipple base 132 providing an opening to the cavity 137 from a distal end of the nipple assembly 130. As in other embodiments, the nipple is configured for sucking and has a nipple aperture 136 at a proximal end of the nipple 134, which provides an outlet through which fluid can flow out of the cavity 137. As shown in the perspective view of FIG. 12B, the distal view of FIG. 12C, and the cross-sectional view of FIG. 12D, the insertable cartridge 200 is configured to securely couple to the nipple base 132 such that, when engaged, at least a portion of the insertable cartridge 200 is coupled to or positioned within the passage and the cavity 137. The insertable cartridge 200 of various embodiments securely couples to the nipple base 132 via threading, a snap fit, or other non-permanent attachment means. The insertable cartridge 200 of some embodiments has a proximal cartridge portion, which includes a reservoir 215 configured to hold a fluid and a cartridge aperture 212 at a proximal tip of the cartridge 200. The insertable cartridge 200 of some embodiments also has a distal cartridge portion, which includes a cap 220 and a pump 222. In the embodiment of FIGS. 12A-12D, the pump 222 is not a separate element, but rather forms a portion of the cap 220. The pump 222 of the illustrated embodiment is a compressible pump configured to be squeezed and non-permanently deformed, for example, between the fingers of a caregiver. In other embodiments, other pump designs may be used, such as for example, a syringe plunger.

When the insertable cartridge 200 is engaged with the nipple assembly 130, the pacifier system 1200 is configured to expel a fluid from the reservoir 215 through the cartridge aperture 212 and out of the nipple assembly 130 through the nipple aperture 136 at least in response to the pump 222 being actuated. In some embodiments, fluid may also be expelled from the reservoir 215 and out the cartridge aperture 212 and the nipple aperture 136 in response to the nipple 134 being sucked. While the cartridge depicted in FIG. 12A has the depicted shape and design, other shapes and designs are contemplated. For example, rather than a pointed tip at aperture 212, the end of the cartridge can be round, for example. In some embodiments, the proximal end of the cartridge 220, when fully inserted into the nipple assembly, contacts an inner proximal end of the nipple or comes very close to contacting a proximal end of the nipple, for example. In one embodiment (not shown), the cartridge is shaped as a syringe body. In such an embodiment, the pump is formed of a plunger, which is configured to be depressed down into the syringe body. In various embodiments, the insertable cartridge 200 may be removed from the apparatus 100 when no longer in use, allowing an individual to continue sucking on the nipple assembly 130. In some embodiments, the cartridge 200 is disposable and configured for a single use. In other embodiments, the cartridge 200 may be reusable and have, for example, a removable cap 220, which a caregiver can remove to fill the cartridge 200 with an amount of fluid.

Figure 13B:
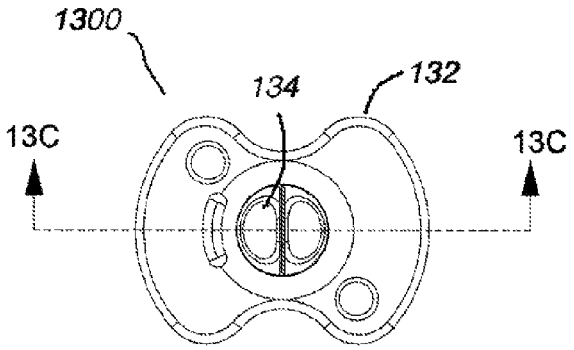
FIG. 13B depicts a bottom/distal view of the embodiment shown in FIG. 13A.
Figure 13A:
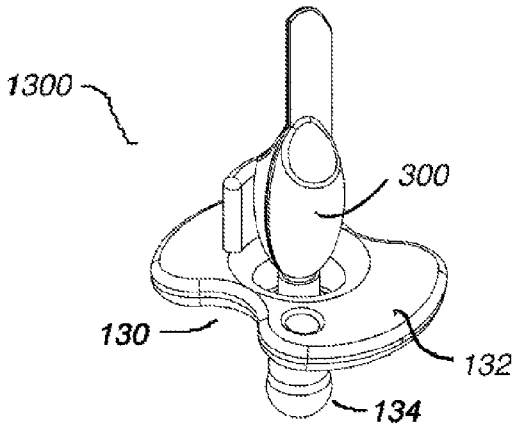
FIG. 13A depicts a perspective view of one embodiment of a pacifier system that includes a nipple assembly and a cartridge.
Figure 13C:
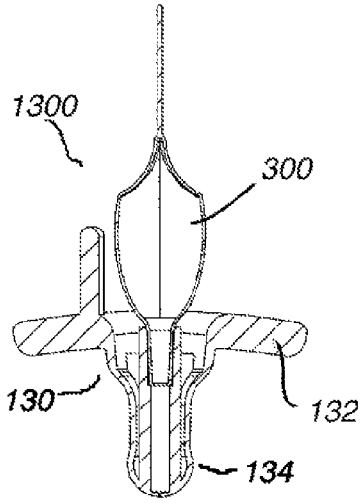
FIG. 13C depicts a cross-sectional view of the embodiment of FIG. 13A. The selected viewing angle of the cross-section is identified in FIG. 13B.
Figure 14A:
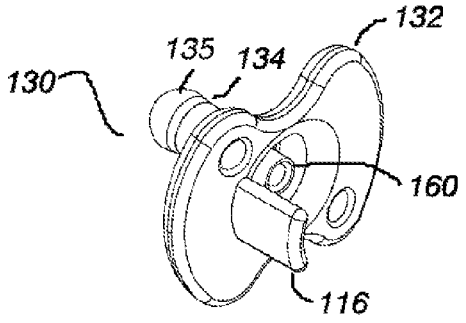
FIG. 14A depicts a perspective view of the nipple assembly embodiment included in FIG. 13A.
Figure 14C:
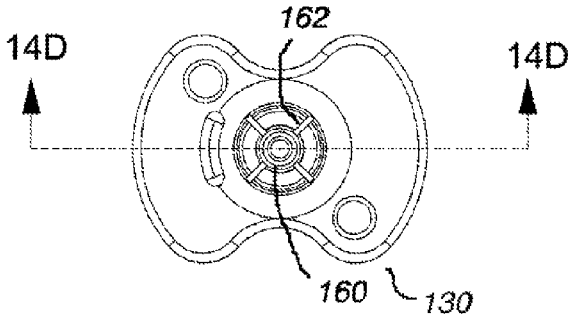
FIG. 14C depicts a bottom/distal view of the nipple assembly embodiment of FIG. 14A.
Figure 14B:
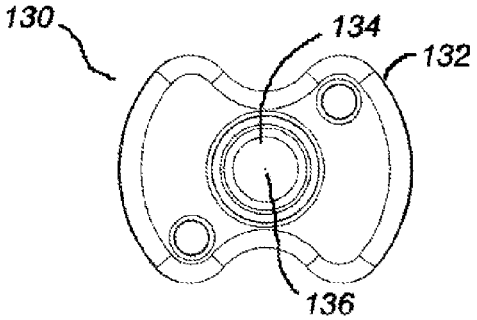
FIG. 14B depicts a top/proximal view of the nipple assembly embodiment of FIG. 14A.
Figure 14D:
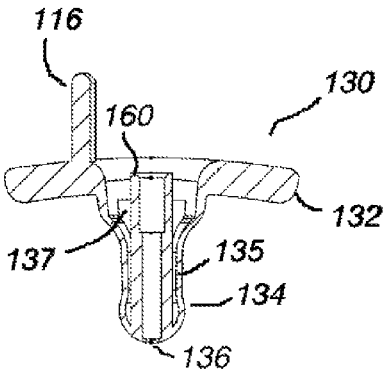
FIG. 14D depicts a cross-sectional view of the nipple assembly embodiment of FIG. 14A. The selected viewing angle of the cross-section is identified in FIG. 14C.
Figure 15A:
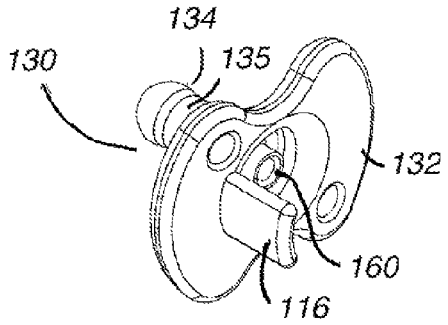
FIG. 15A depicts a perspective view of another embodiment of a nipple assembly.
Figure 15C:
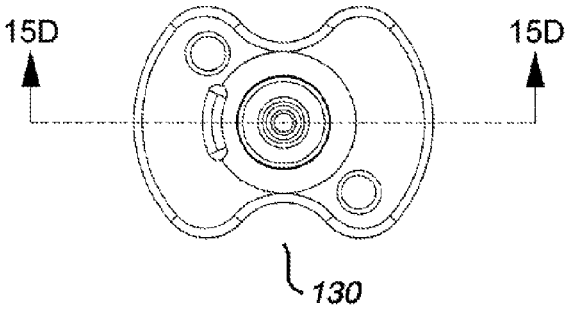
FIG. 15C depicts a bottom/distal view of the nipple assembly embodiment of FIG. 15A.
Figure 15B:
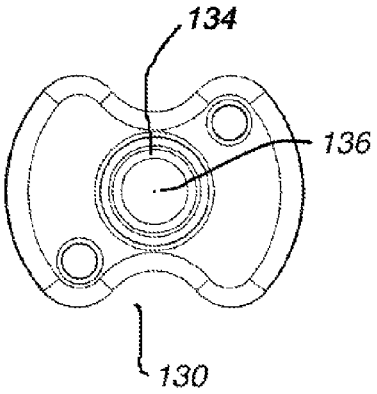
FIG. 15B depicts a top/proximal view of the nipple assembly embodiment of FIG. 15A.
Figure 15D:
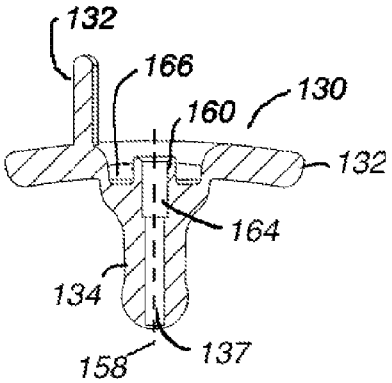
FIG. 15D depicts a cross-sectional view of the nipple assembly embodiment of FIG. 15A. The selected viewing angle of the cross-section is identified in FIG. 15C.

An additional embodiment of a pacifier system is depicted in FIGS. 13A-13C. The pacifier system 1300 includes a pacifier apparatus in the form of a nipple assembly 130, and additionally, a cartridge 300. The nipple assembly 130 includes a nipple 134 and a nipple base 132.

The pacifier system embodiments formed from a pacifier apparatus and a cartridge, such as, for example, the embodiments depicted in FIGS. 12A-13C may be packaged and sold as an interchangeable kit, for example. In one embodiment, the kit includes a plurality of insertable cartridges, for example cartridges 200 or 300, with each cartridge containing a predetermined volume of a predetermined fluid. Each cartridge within the kit may be configured for a single use. In some embodiments, the kit also includes one or more pacifier apparatuses having some or all of the characteristics of the above-described nipple assembly 130. The nipple assembly 130 embodiments described herein may be adapted for one-time use or they may be reusable. The nipple assembly 130 of various embodiments is configured to couple to a plurality of cartridges individually, and interchangeably. In addition or alternatively, as described in more detail below, the nipple assembly 130 may be configured to couple to more than one cartridge at a time. For example, one cartridge may be prefilled with sucrose, while the second cartridge is prefilled with a medicament. In some embodiments, the nipple assembly 130 is configured to couple to cartridges having reservoirs of varying sizes intended to hold varying amounts of fluid.

The nipple assembly 130 of FIGS. 13A-13C is depicted in FIGS. 14A-14D in more detail. As in other embodiments, the nipple 134 extends proximally from the nipple base 132 and the shape of the nipple 134 is defined, at least in part, by a contoured nipple wall 135. In the depicted embodiment, the nipple wall 134 defines the perimeter of a nipple cavity 137. In some embodiments, and as shown in FIGS. 14A-14D, a receiving tube 160 is disposed within the nipple 134, for example, within the nipple cavity 137. In some embodiments, a plurality of receiving tubes may be disposed within the nipple cavity 137. In various embodiments, the one or more receiving tubes 160 are fixedly attached to, or formed in connection with, a proximal, inner portion of the nipple wall 135. In some embodiments, the one or more receiving tubes 160 are held in place, at least in part, by one or more support struts 162; in other embodiments, no support struts 162 are present. Additionally or alternatively, in some embodiments, the one or more receiving tubes 160 are supported, at least in part, by one or more regions of thickened nipple wall 135, which contact the receiving tube 160 within the nipple cavity 137 and/or in the passage of the nipple base 132.

In other embodiments, such as, for example, the nipple assembly 130 embodiment of FIGS. 15A-15D, the nipple wall 135 has one or more thickened regions, which partially fill in a portion of the nipple 134 such that an inner portion of the nipple wall 135 defines a lumen. In such embodiments, this lumen forms the receiving tube 160. In such embodiments, the thickness and diameter of the nipple wall 135 may be constructed to prevent the nipple 134 from collapsing in the absence of support struts 162. In some embodiments, the material and thickness of the nipple wall 135 are selected such that applying a sucking force to the nipple 134 can cause the receiving tube 160 to non-permanently deform and contract radially inward toward a central axis 158. In some embodiments, the material and thickness of the nipple wall 135 are selected such that an average sucking force of a child can cause a diameter of the receiving tube 160 to narrow at least 1% to 90%, 95%, 96%, 97%, 98%, or 99%, or any sub-range or value therebetween. In some embodiments, a region of the nipple wall 135 may be thinner than the surrounding nipple wall 135 such that the region is more prone to contraction around the receiving tube 160 at that region. In some embodiments, the receiving tube 160 may be manufactured in a contracted state, and a pressure force, such as a syringe or cartridge expelling a fluid inside the receiving tube 160, may cause a diameter of the receiving tube 160 to expand radially outward.

In various embodiments, such as, for example, the nipple assembly 130 embodiments of FIGS. 14A-14D and 15A-15D, the receiving tube 160 extends through the nipple 134, and optionally, into the passage of the nipple base 132, and optionally, distally beyond the distal face 131. In various embodiments, the receiving tube 160 can be accessed from a distal side of the nipple assembly 130, and the receiving tube 160 is sized and configured to receive a cartridge 300 from the distal side of the nipple assembly 130. In some embodiments, the receiving tube 160 is uniform in shape; in other embodiments, it includes one or more fitted features, such as, for example, an expanded distal tube portion 164, configured to securely receive a portion of the cartridge 300 or a portion of a medical instrument. For example, in some embodiments, the expanded distal tube portion 164 is configured to receive and couple to a cartridge spout (for example, the cartridge spout 320 of FIGS. 16A-16F) such that the cartridge spout 320 terminates within the expanded distal tube portion 164 and fills all or substantially all of the expanded distal tube portion 164.

Figure 23A:
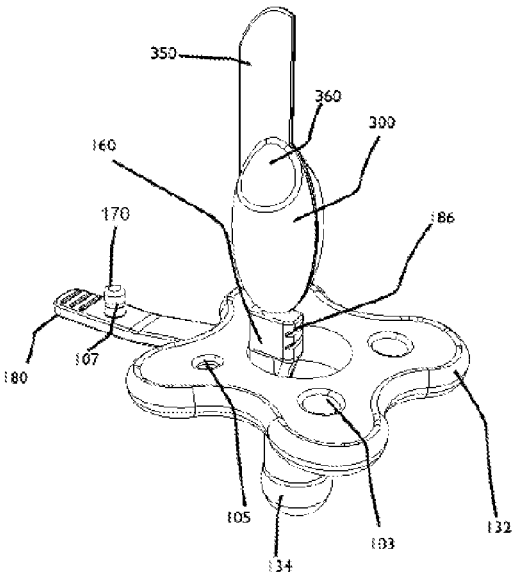
FIG. 23A depicts a perspective view of an embodiment of a pacifier system that includes a nipple assembly and a cartridge.
Figure 23B:
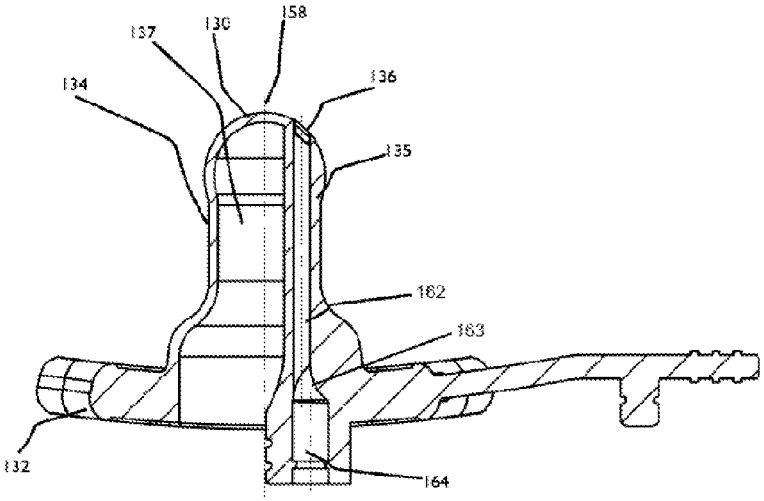
FIG. 23B depicts a cross-sectional view of the nipple assembly embodiment of FIG. 23A.

In other embodiments, the receiving tube 160 includes three distinct portions, for example, an expanded distal tube portion 164, a medial tube portion 163, and a proximal tube portion 162 (see, for example, FIG. 23B). In some such embodiments, the medial tube portion 163 has a smaller diameter than the expanded distal tube portion 164, and the proximal tube portion 162 has a smaller diameter than the medial tube portion 163. In some embodiments, for example, the embodiment depicted in FIGS. 23A-23B, the medial tube portion 163 is tapered so as to funnel fluid from a cartridge spout 320 or other fluid-delivering instrument within the expanded distal tube portion 164 to the narrower proximal tube portion 162. In some embodiments, the gradual or progressive narrowing of the receiving tube 160 helps regulate and control fluid flow. In some embodiments, the gradual or progressive narrowing of the receiving tube 160 is designed to funnel fluid toward the nipple aperture 136 to facilitate the extrusion of all fluid from the receiving tube 160. Such a design may prevent fluid from getting stuck within the nipple assembly 130; that is, such a design may eliminate or minimize dead space. The receiving tube may have any suitable length and diameter. For example, the length may be selected to ensure the receiving tube 160 extends the length of the nipple, through the passage of the nipple base, and at least slightly beyond the distal end of the nipple base. For example, the receiving tube may extend 1 mm to 10 cm beyond the distal end of the nipple base. In some embodiments, the receiving tube is sized and shaped to contain a volume of fluid between 0.01 cc's and 0.5 cc's. The receiving tube 160 of some embodiments has an inner diameter between 0.01 mm and 12.0 mm, and preferably between 0.07 mm and 7.0 mm, and the inner diameter may include any sub-range or individual value therebetween. The selected diameter of the receiving tube 160 may depend on the size of the healthcare accessory to which the receiving tube 160 is configured to couple.

In several embodiments, the receiving tube 160 of the nipple assembly 130 is configured to couple, either directly or indirectly, to various accessories, making each of these nipple assembly 130 embodiments a versatile tool for administering fluid and/or orally-administered medical instruments to young, infirmed, or disabled populations. As non-limiting examples, in some embodiments, the nipple assembly 130 is configured to couple to luer lock syringes and enteral feeding syringes of various geometries and to extrusions such as extrusion tubing connected to powered and non-powered devices. In some embodiments, the nipple assembly 130 is configured to couple to intra-esophageal catheters, imaging scopes, intubation tubes, transitional feeding attachments, and other orally-delivered medical instrumentation. As shown, for example, in FIG. 15D, some embodiments of the nipple assembly 130 have a recessed portion 166 within a passage of the nipple base 132 between the inner receiving tube 160 and the walls of the nipple base 132. The recessed portion 166 of some embodiments is designed to allow enteral feeding syringes or other instrumentation to couple to the receiving tube 160. Further, in some embodiments, the recessed portion 166 allows for any medication or fluid that may have leaked from a cartridge during insertion into the receiving tube 160 to be quickly and cleanly retrieved. The recessed portion 166 of various embodiments may be of any suitable shape and size, and the walls defining the recessed portion 166 may be positioned at any desirable angle.

The nipple assembly 130 embodiments depicted in FIGS. 14A-15D also have a handle 116 extending from the base 132 for easy insertion and removal of the nipple assembly 130 by a healthcare provider, for example, from the mouth of an infant and/or patient. As in other embodiments, the nipple 134 is configured for sucking and has a nipple aperture 136 at a proximal end of the nipple 134, which provides an outlet through which fluid can flow out of the cavity 137.

FIGS. 16A-16F depict various views of the cartridge 300 embodiment shown in the pacifier system 1300 of FIGS. 13A-13C. The cartridge 300 includes a cartridge body 310 defining a reservoir configured to house a fluid, such as, for example, a medicament, nutritional supplement, or analgesic. The cartridge 300 also includes a proximal cartridge spout 320 configured to fit within the receiving tube 160 of the nipple assembly 130. In some embodiments, at least a portion of the cartridge body 310 is flexible and/or deformable, for example, to allow a healthcare provider to squeeze the cartridge body 310 to urge fluid out of the reservoir, through the spout 320, out a cartridge aperture 330, and into the receiving tube 160 of the nipple assembly 130.

In some embodiments, the cartridge 300 is prefilled with a pre-measured dose of a liquid. The size of the reservoir, and therefore, the surrounding cartridge body 310, may vary depending on the amount of liquid provided within the cartridge 300. In some embodiments, the cartridge 300 contains 0.01 mL to 10.0 mL of liquid, or any sub-range or individual value therebetween. For example, in some such embodiments, the cartridge 300 contains 0.1 mL to 5.0 mL of liquid. In one non-limiting example, the cartridge 300 is sold prefilled with 2.0 mL of liquid.

Figure 16A:
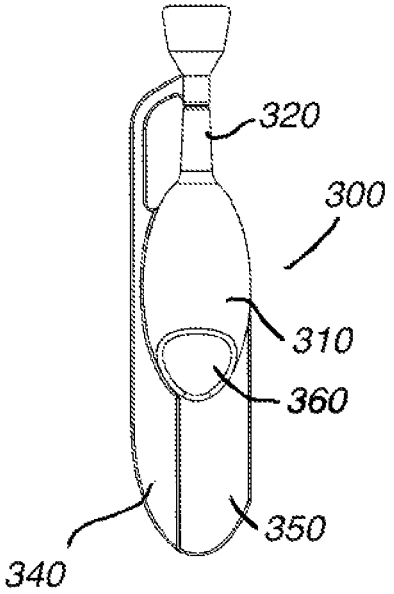
FIG. 16A depicts a front view of the cartridge embodiment included in FIG. 13A.
Figure 16B:
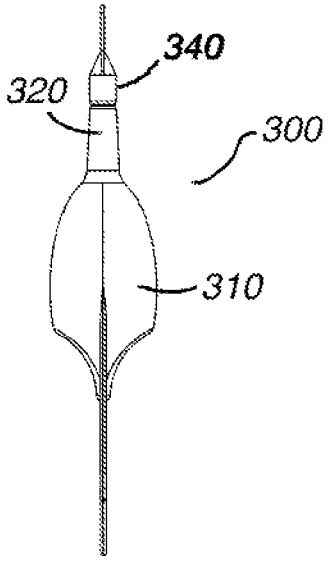
FIG. 16B depicts a side view of the cartridge embodiment of FIG. 16A.
Figure 16C:
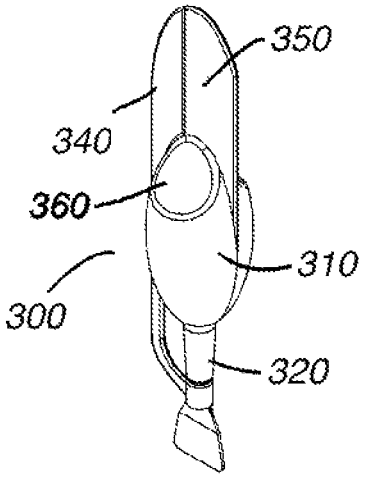
FIG. 16C depicts a perspective view of the cartridge embodiment of FIG. 16A.
Figure 16D:
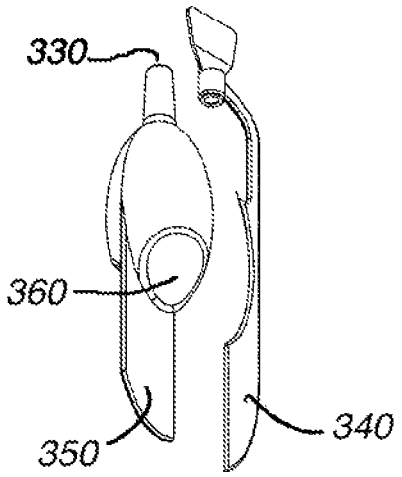
FIG. 16D depicts a perspective view of the cartridge embodiment of FIG. 16A with a seal removed.
Figure 16E:
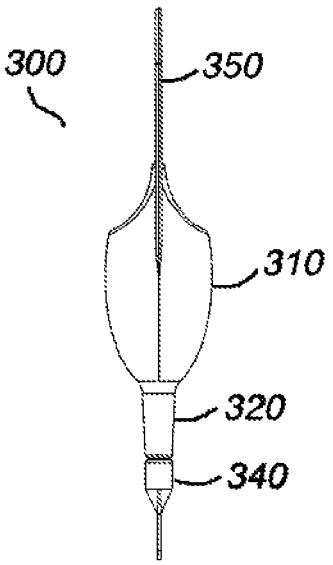
FIG. 16E depicts a side view of the cartridge embodiment of FIG. 16A with a seal removed.
Figure 16F:
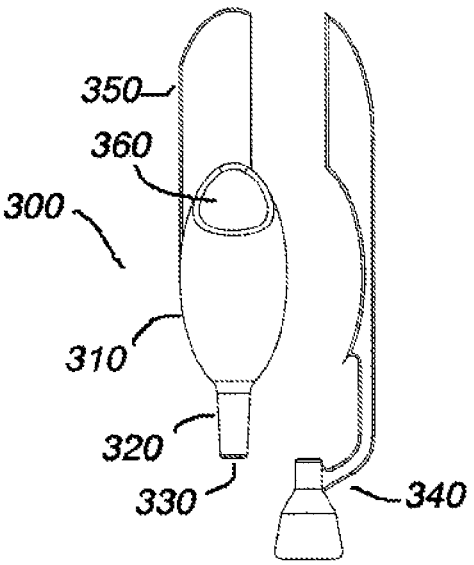
FIG. 16F depicts a front view of the cartridge embodiment of FIG. 16A with a seal removed.
Figure 17E:
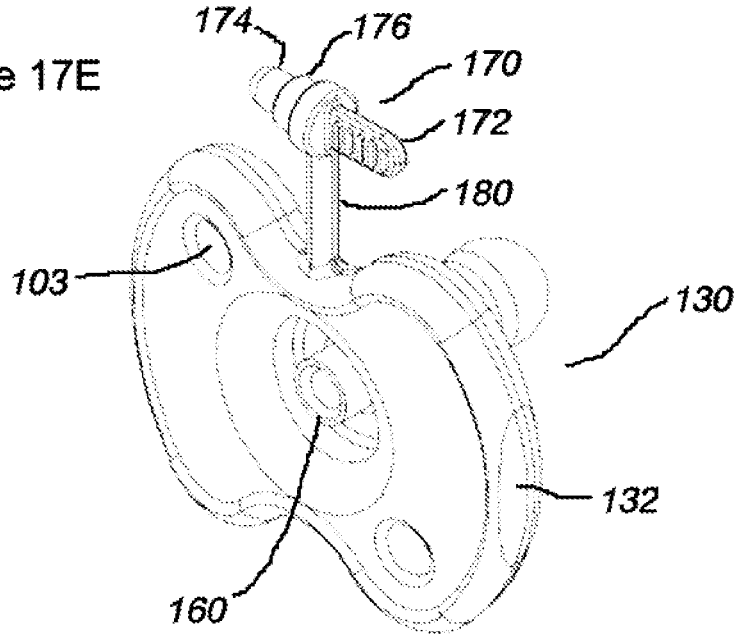
FIG. 17E depicts another perspective view of the nipple assembly embodiment of FIG. 17A.

As shown in FIGS. 16A-16C, before use, some embodiments of a cartridge 300 include a cartridge seal 340. In such embodiments, the cartridge seal 340 prevents fluid from leaking out of the cartridge spout 320 prior to use. In some embodiments, the cartridge seal 340 also acts as a hermetic seal, maintaining a sterile environment within the spout 320 and reservoir of the cartridge 300 prior to use. In some embodiments, the seal 340 can be fully torn off, cut off, or otherwise removed by a user prior to use. The connection between the seal 340 and the cartridge 300 of some embodiments is perforated or indented, for example, to facilitate breakage of the seal 340 from the cartridge 300. FIGS. 16D-16F provide views of the cartridge 300 with the cartridge seal 340 fully removed. In other embodiments, only a proximal portion of the seal 340 is configured to be broken off and detached from the cartridge spout 320 so as to expose the cartridge aperture 330. In some such embodiments, the seal 340 is configured to flex and bend at one or more locations, for example, at a perforation line located on the seal 340 between the detachable portion and a permanently attached portion, thereby allowing the proximal portion of the seal 340 to be broken and moved out of the way while maintaining its attachment to the cartridge body 310.

In some embodiments, a tab 350 remains attached to a distal end of the cartridge body 310 after the seal 340 is torn.

The tab 350 of some embodiments acts as a handle, facilitating cartridge's 300 insertion into, and removal from the nipple assembly 130.

In some embodiments of the cartridge 300, at least a portion of the cartridge body 310 is flexible and deformable. In some embodiments a significant portion of the body 310 is deformable, for example, at least the entire bulbous portion. In some embodiments, the cartridge body 310 allows for repeatable actuation of a substance, for example a fluid, with all or some of the cartridge body 310 non-permanently deforming with each actuation. In some embodiments, two or more recessed finger gripping portions 360 are provided to facilitate gripping; in some such embodiments, the finger gripping portions 360 are less flexible than the bulbous portion, so as to limit unintentional expulsion of fluid during insertion or removal of the cartridge 300 from a pacifier apparatus. Additionally, in some embodiments, the gripping portion 360 has a plurality of defined edges, which create tension and shape memory within the cartridge body 310, such that following an actuation of the cartridge body 310, the cartridge body 310 will return to its original position. In various embodiments, pressing on a portion of the cartridge body 310 actuates the cartridge 300, causing the liquid stored inside the reservoir of the cartridge 300 to flow through the cartridge aperture 330 and out the nipple aperture 136. Additionally or alternatively, in some embodiments, the cartridge body 310 may deform from negative pressure created when an infant or other individual sucks on the nipple 134 of the attached nipple assembly 130. Alternatively, in embodiments not shown, the cartridge body 310 may deform permanently; in some such embodiments, the deformation may serve as a visual indicator to a user that a liquid or substance has been expelled through the cartridge aperture 330.

In various embodiments, the spout 320 is sized and shaped to fit securely within the receiving tube 160 of a nipple assembly 130. In some embodiments, the spout 320 has an outer diameter between 0.01 mm and 12.0 mm, and the spout diameter may include any sub-range or individual value therebetween. In some embodiments, the diameter of the spout 320 is between 0.06 mm and 6.0 mm. In some embodiments, the diameter of the spout 320 is uniform. In other embodiments, the spout 320 is tapered such that the spout 320 narrows in a proximal direction; in such embodiments, both the largest outer diameter of the spout 320 and the smallest outer diameter of the spout 320 are within the ranges provided above. In various embodiments of the nipple assembly 130, the diameter of the receiving tube 160 is slightly larger than the cartridge spout diameters to which it couples, such that at least a portion of an inner wall of the receiving tube 160 is in contact with at least a portion of an outer wall of the spout 320.

In various embodiments, the height and diameter dimensions of the cartridge 300 are selected so as not to pose a choke hazard to young children. For example, in some embodiments, the diameter of the cartridge 300 is at least 1.25 inches. Additionally or alternatively, in some embodiments, the height of the cartridge 300 is at least 2.25 inches. As shown in FIGS. 16A-16F, in some embodiments, the cartridge seal 340 runs at least the length or substantially the length of the cartridge 300 such that, when detached to open the cartridge aperture 330, no aspect of the broken seal 340 poses a choking risk. Accordingly, the cartridge 300 of some embodiments is formed such that, when separated, both the seal 340 and the remainder of the cartridge 300 independently conform to choke hazard regulations. For example, when detached, the cartridge seal 340 of some embodiments also has a diameter or width of at least 1.25 inches and/or a height of at least 2.25 inches. In one non-limiting example, the length of the cartridge 300 from a distal tip of the tab 350 to the proximal tip of the cartridge aperture 330 is approximately 2.5 inches; the length of the removable seal 340 at its longest location is approximately 3.1 inches; and the length of the pacifier apparatus 100 with the cartridge 300 securely positioned within the nipple assembly 130 is approximately 3.3 inches. In another embodiment, the length of the cartridge 300 and the length of the seal 340 is 2.25 inches, 5 inches, or any value therebetween. In another embodiment, the diameter or width of the cartridge 300 and the diameter or width of the seal 340 is 1.25 inches, 3 inches, or any value therebetween, for example, 1.5 inches or about 1.5 inches. In other embodiments, other dimensions are selected. In some embodiments, the seal 340 is not fully detachable from the cartridge 300 but rather is permanently attached to the cartridge 300 at one or more sites remote from the cartridge aperture 330. In some such embodiments, the portion of the seal 340 that is moveable may be sized to pass choke test standards. In other such embodiments, the moveable portion of the seal may have a maximum length smaller than 2.25 inches and a maximum width smaller than 1.25 inches. In some embodiments in which the seal 340 is not fully detachable, the seal 340 is formed of a material having sufficient strength to withstand considerable force without full separation from the cartridge 300. In various embodiments, both the cartridge 300 and the seal 340 are each configured to withstand considerable force without failing. Failure may include cracking, breaking, separation of a portion configured to be permanently coupled, or deforming to a shape that would prevent the cartridge 300 or the seal 340 from passing choke test standards. For example, in some embodiments, the seal 340 and the cartridge 300 are able to withstand at least 0.5 pounds, 20 pounds, or any value therebetween of force, such as torque or tension, without failing. In one embodiment, the seal 340 and the cartridge 300 are each able to withstand at least 1 pound of force without failing; in another embodiment, the seal 340 and the cartridge 300 are able to withstand at least 5 pounds of force without failing. In some embodiments, any or all of the cartridge 300 components are formed of a plastic, silicone, rubber, other polymer of polymer composite, or any other suitable material.

While the cartridge 300 of various embodiments may be coupled to a nipple assembly 130 as described herein to form a complete pacifier apparatus or system, the cartridge 300 of some embodiments may additionally or alternatively be used independently to administer fluids to individuals. For example, the systems of hermetically sealed cartridges filled with liquid described herein may be positioned directly into an individual's mouth. In use, an individual may suck directly from the cartridge aperture 330 or the cartridge 300 may be squeezed such that the liquid is expelled from the cartridge aperture 330 directly onto the inner cheek or the tongue of an individual.

FIGS. 17A-17E depict various views of a nipple assembly 130 embodiment configured for use with a cartridge, such as, for example, the cartridge of FIGS. 16A-16F. As shown in the various views, the nipple assembly 130 of the present embodiment includes a plug 170 and a strap 180. The strap 180 functions to secure the plug 170 to the nipple assembly 130. In some embodiments, the strap 180 is flexible and may be rounded, flat, or any other suitable shape or configuration. In some embodiments, the strap 180 has a first end attached to the nipple base 132 and a second end attached to the plug 170. In some embodiments, the plug 170 has a first portion 172 with ribs, depressions, traction pads, or other features configured to facilitate gripping of the plug 170 by a caregiver. In other embodiments, ribs, depressions, or other traction features may be formed or disposed on the strap 180. The plug 170 of some embodiments has a lateral portion 174 sized and configured to securely fit within a portion of the receiving tube 160. The plug 170 is provided for insertion into a distal end of the receiving tube 160 when no cartridge 300 is secured within the receiving tube 160. When the lateral portion 174 of the plug 170 is placed within the distal end of the receiving tube 160, the plug 170 is configured to fully or substantially occlude the flow of air into the receiving tube 160 from the distal end. In some embodiments, the plug 170 functions to minimize a fluid-receiving individual's ingestion of air through the pacifier apparatus. Additionally, some embodiments of the plug 170 include a medial portion 176 sized and configured to securely fit within a through-hole 103 of the nipple base 132. Such a configuration allows the plug to be placed into a through-hole 103 and out of the way of the user when a cartridge 300 is in position within the receiving tube 160. In other embodiments, the entirety of the plug 170 or a substantial portion of the plug 170 fits securely within both the receiving tube 160 and one or more through-holes 103.

Figure 18:
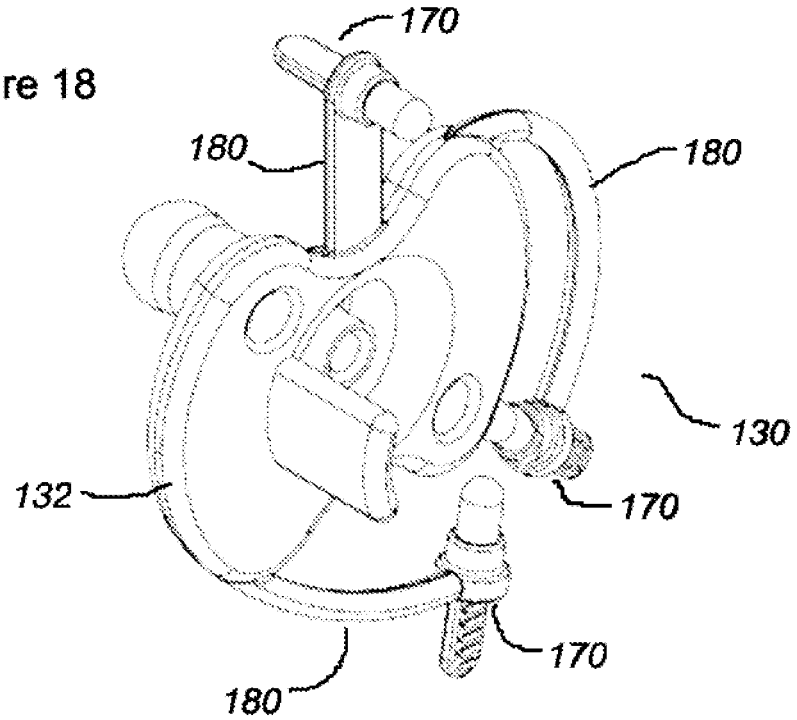
FIG. 18 is a perspective view of another embodiment of a nipple assembly configured to receive a cartridge.

FIG. 18 depicts an additional embodiment of a pacifier apparatus in the form of a nipple assembly 130 configured for use with a cartridge, such as, the cartridge of FIGS. 16A-16F. FIG. 18 depicts three non-limiting examples of possible placements of the plug 170 and the strap 180 in relation to the nipple base 132.

Figure 22:
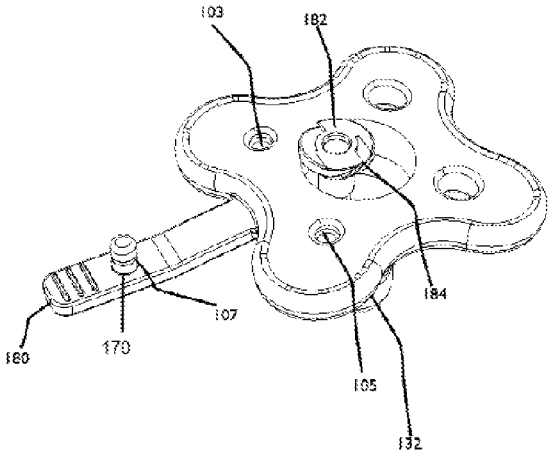
FIG. 22 depicts a perspective view of an embodiment of a nipple assembly configured for the oral administration of fluids.

An additional embodiment of a pacifier apparatus in the form of a nipple assembly 130 is provided in FIG. 22. The depicted nipple assembly 130 of the present embodiment includes a valve 182. A cartridge 300, medical instrumentation, or a connector may couple to the valve 182. In some embodiments, the valve 182 functions to occlude the receiving tube 160 in order to prevent ingestion of air by an individual sucking on the nipple 134 when no cartridge 300 or similar apparatus is coupled to the receiving tube 160. In some embodiments, the valve 182 is provided in addition to a strap 180 with a plug 170. In other embodiments, the valve 182 eliminates the need for the plug 170 and the strap 180. In some embodiments, the valve 182 includes a connector portion, such as, for example, valve threads 184, which may be located external or internal to the receiving tube 160. The valve 182 of various embodiments also includes a fluid occluding portion internally disposed within the receiving tube 160. In some embodiments, the fluid occluding portion of the valve 182 is positioned within the expanded distal portion 164, for example, at the proximal end of the expanded distal portion 164. In other embodiments, the fluid occluding portion of the valve 182 is positioned within the medial tube portion 163 or the proximal tube portion 162. The fluid occluding portion of the valve 182 is configured to transition from a closed state to an open state when acted upon by a sufficient force. For example, the valve 182 of FIG. 22 remains in a closed state until acted upon by a force such as expulsion of fluid from the cartridge 300. In other embodiments, the valve 182 is positioned to open when a cartridge 300 is inserted into the receiving tube 160. The valve 182, in some embodiments, is configured to transition from a closed state to an open state when a pressure greater than 2 kilopascals (kPa) is acted on it. In other embodiments, the valve 182 transitions to an open state when a pressure greater than 44 kPa acts on it. In still other embodiments, the minimum pressure needed to transition the valve from a closed state to an open state is an individual value between 2 kPa and 44 kPa, for example, 5 kPa, 10 kPa, 15 kPa, 20 kPa, 25 kPa, 30 kPa, 35 kPa, or 40 kPa. Additionally or alternatively, the valve 182, in some embodiments, is designed to withstand a minimum negative pressure of 200 mmHg without transitioning out of the closed state. Such a pressure may, for example, be exerted by the sucking of an aged one- to thirty-day post-partum infant.

The valve 182 of some embodiments is formed of a material or composite of materials selected from the group consisting of: silicone, rubber, plastic, and other polymers. In other embodiments, any other suitable material may be used. In some embodiments, the valve 182 has an internal diameter taper ratio between 0.140" and 0.300", while the valve threading 184 has an outside diameter between 0.200" and 0.500". The valve 182 may be molded into the receiving tube 160. In some embodiments, the valve 182 replaces the expanded distal tube portion 164. In other embodiments, the valve 182 may be overmolded to the receiving tube 160, for example, using materials and polymers known to withstand greater than 300° melting temperatures. In yet other embodiments, the valve 182 may be fixedly attached to the receiving tube 160 by gluing, ultrasonically welding and/or through other adhesive means. In another embodiment, manufacturing a valve 182 within the receiving tube 160 includes forming a valve 182, separately forming a nipple assembly 130 having a receiving tube 160 with an expanded distal tube portion 164 molded to fixedly retain the valve 182, and upon demolding of the nipple assembly 130, promptly placing the valve 182 within the expanded distal tube portion 164. As the molded polymers or other materials forming the nipple assembly 130 cool, they contract and fixedly secure around and upon the valve 182. The valve 182 of some embodiments is constructed to withstand separation from the receiving tube 160 at least when a tension force up to 10 lbs is exerted on it in any direction from the nipple assembly 130.

The valve 182 and valve threads 184 are designed to couple to a variety of specialty syringes and connectors, such as those found in neonatal feeding syringes and syringe extenders. In some embodiments not shown, the valve 182 may connect to such devices without the valve threads 184 but through a slip-fit, snap fit, friction fit, or other coupling means. In some embodiments, the valve 182 is sized and shaped to prevent coupling with traditional luer lock tapered syringes or with syringes of certain sizes. In one such embodiment, the valve 182 is molded such that the diameter of the valve threads 184 has a size and shape that enables coupling to oral syringes but not luer lock syringes. For example, in one embodiment, the valve 182 with the valve threads 184 has an outer diameter between 0.20" and 0.50", which prevents traditional luer lock designs from coupling. Such a safety feature may be helpful in a clinical setting to reduce errors; specifically, such a feature may help ensure that the nipple apparatus 130 is only coupled to devices intended for oral administration, such as oral syringes, and not intravenous syringes.

FIG. 23A illustrates one embodiment of a system for administering fluids, which includes characteristics to both control, and direct the angle of, fluid flow. Such an embodiment may be advantageous in light of the fact that premature infants and neonates are sensitive to rates of fluid flow. In the depicted embodiment, a receiving tube 160 is fixedly disposed within the interior of a nipple 134 and extends proximally to the nipple aperture 136. When a cartridge 300 is not coupled to the receiving tube 160, the plug 170 on the strap 180 may couple to the receiving tube 160 and block the inlet to the receiving tube 160, allowing the nipple apparatus 130 to act as a soother while preventing air ingestion. The plug 170 of some embodiments is also configured to securely fit within a through-hole 103 within the distal face of the nipple base 132 when the receiving tube 160 is occupied.

In some embodiments of the nipple assembly 130, for example, the nipple assembly 130 of FIG. 23A and FIG. 23B, the receiving tube 160 is disposed within the nipple cavity 137 offset from a central axis 158. The nipple aperture 136 is also offset from the central axis 158. Advantageously, in such configurations, dispensed and/or ingested fluid exits the nipple aperture 136 offset from a central axis 158, thereby minimizing unexpected direct expulsions of fluid into the mouth of a user, and thus, minimizing unwanted physiologic reactions such as choking and/or a gag reflex. Furthermore, such a configuration may be advantageous because hospital protocols for sucrose dispensing increasingly call for sucrose to be administered toward an infant's cheek or buccal surface. Additionally, some premature babies require a dextrose gel to be applied inside the infant's cheek to control hypoglycemia or low blood sugar levels. The disclosed embodiment may address these needs by allowing for fluid and/or gel delivery at a desired angle and orientation within an infant's oral cavity. In some embodiments, the nipple aperture 136 may be disposed on the proximal/bulbous end of the nipple offset from the central axis 158 of the nipple assembly 130 by 1° to 120°, for example, by 10°, 90°, or any value therebetween. In some such embodiments, the receiving tube 160 is laterally affixed to an inner side of the nipple wall 135. In some embodiments, the receiving tube 160 is at least partially defined by an inner side of the nipple wall 135.

In some embodiments, the nipple cavity 137 is hollow; in the alternative, to create a nipple assembly 130 having a greater density and/or improved structural integrity, some or all of the nipple cavity 137 may be filled with the same material that forms the nipple wall 135. In some embodiments, a plurality of receiving tubes 160 are disposed within the nipple cavity 137.

Figure 19A:
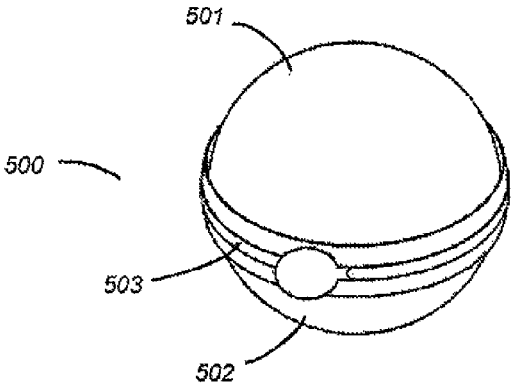
FIG. 19A depicts a perspective view of one embodiment of a sterile packaging unit for any of the apparatuses disclosed herein.
Figure 19B:
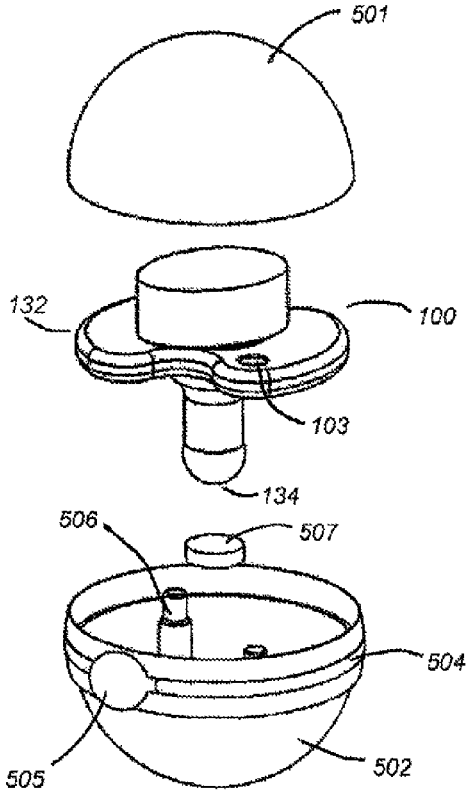
FIG. 19B depicts an exploded view of one embodiment of a system, which includes an apparatus configured for the oral administration of fluids and a sterile packaging unit.
Figure 19C:
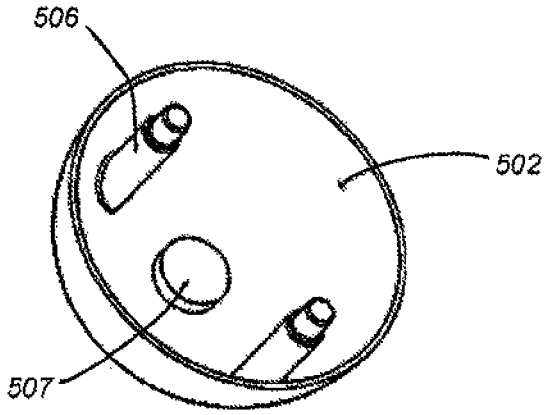
FIG. 19C depicts a perspective view of one embodiment of a proximal portion of a sterile packaging unit.
Figure 19D:
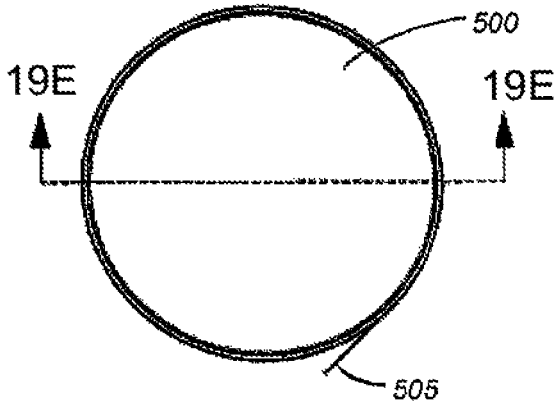
FIG. 19D depicts a distal view of one embodiment of a sterile packaging unit.
Figure 19E:
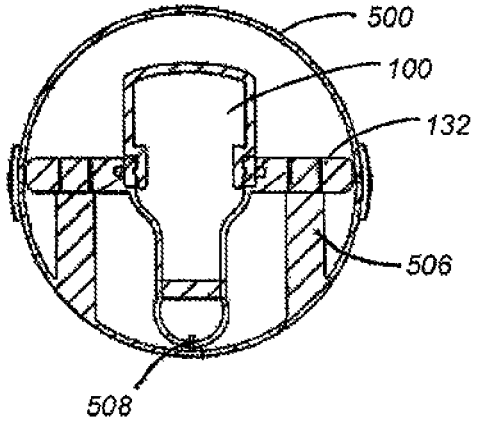
FIG. 19E depicts a cross-sectional view of the sterile packaging unit embodiment illustrated in FIG. 13D.

FIGS. 19A-19E illustrate an example of one embodiment of a packaging unit for the pacifier apparatuses and/or nipple assemblies described herein. In the perspective view of FIG. 19A, the packaging unit includes a shell 500 having a distal shell member 501, a proximal shell member 502, and an attachment element 503 configured to detachably connect the distal shell member 501 and the proximal shell member 502. As shown in the exploded view of FIG. 19B and the perspective view of the proximal shell member provided in FIG. 19C, the shell 500 of some embodiments has a plurality of anchor arms 506 extending from an inner surface of the shell 500 into an interior of the shell 500. The plurality of anchor arms 506 are configured to secure any of the pacifier apparatuses described herein. Reference will be made to the pacifier apparatus 100 of FIGS. 9A-9C as a non-limiting example only. In some embodiments, the plurality of anchor arms 506 secure the pacifier apparatus 100 in a stable position inside the shell 500 by engaging with the one or more through-holes 103 located in the nipple base 132 or simply by holding the apparatus in a non-movable position, for example. Such a position of engagement is illustrated in the cross-sectional view of FIG. 19E. In some embodiments, such as the one of FIGS. 19A-19E, the attachment element 503 includes a pull seal 504 configured to wrap substantially around a circumference of the shell 500 and a pull tab 505 affixed to an end of the pull seal 504. The pull seal 504 fixedly couples the distal shell member 501 to the proximal shell member 502 until the pull-tab 505 is pulled and the pull seal 504 is removed. The pull seal 504 of FIGS. 19A and 19B can be attached to a proximal end of the distal shell member 501 and a distal end of the proximal shell member 502, for example, via a perforated connection. Alternatively, in some embodiments, the attachment element 503 and pull seal 505 are built into one or both of the distal or proximal shell member. In some embodiments, the distal shell member and proximal shell member each include a portion of the attachment element; for example, in some embodiments, each shell member has a ridge, groove, threading or the like, which couples one portion of the attachment element to the other portion of the attachment element 503. In various embodiments, the attachment element 503 keeps the shell 500 hermetically sealed such that the sterility of the apparatus 100 is maintained until the seal is broken prior to use. The packaging unit may additionally include, for example, a double-sided adhesive pad 507, as shown in FIGS. 19B and 19C, or an anchor stub 508, as shown in FIG. 19E, positioned on an inner surface of the proximal shell member 502. The adhesive pad 507, anchor stub 508, or other suitable sealant mechanism is provided for engagement with the nipple aperture 136, for example, in order to prevent fluid from leaking out of the nipple aperture 136 of some embodiments prior to use. In some embodiments, the anchor stub 508 may additionally be used to pierce the nipple wall and initially create the nipple aperture 136 instead of making the nipple aperture 136 manufacture or assembly. In some embodiments, the anchor stub has a sharp, pointed, or jagged end. In other embodiments, it has a rounded or blunt end. The shell as depicted has a spherical or rounded shape. It should be understood that any other shape may be used and all suitable three-dimensional shapes are contemplated, for example, cubic, rectangular, pyramidal, oval, cylindrical, trapezoidal, etc. shapes. In some embodiments, the apparatuses, components (e.g., cartridges), etc. may be packaged in a paper, foil and/or plastic wrapper that can be cut or torn open, or that can be separated, for example, and then thrown away. In some embodiments, the items are vacuum packaged inside the outer wrapper.

In some embodiments, the pacifier apparatus 100 is either sterilized or manufactured under sterile conditions and then packaged into the above-described shell or other packaging unit before any fluid or cartridge is added to the apparatus 100. In such embodiments, a healthcare provider, technician or caregiver, prior to use, would add fluid or attach the cartridge. In some embodiments, fluid or a fluid precursor is added to the cavity 137 of the apparatus 100 before the apparatus is sealed within a sterile packaging unit. In various embodiments containing fluid in the cavity 137, the fluid has a desired or a known volume, composition, and concentration. In one particular embodiment, the fluid may include, for example, about 0.5 to about 4 mL (preferably about 2 mL) of a 24% USP sucrose solution. In other embodiments, different volumes, concentrations, and/or different fluids are provided. In some embodiments, the fluid includes, for example, a probiotic formula, a vitamin formula, a nutritive formula, breast milk, colostrum, sweetened water, an anti-gas solution, or a liquid medication. In order to extend the shelf life or portability of the system, the apparatus 100 of some embodiments is packaged so as to contain a fluid precursor. One such fluid-precursor is, for example, a liquid-filled gel capsule. In such an embodiment, a coating of the liquid-filled gel capsule may be configured to dissolve when subjected to a known environmental trigger in order to release the stored fluid into the cavity 137. Such environmental triggers may include, without limitation, exposure to heat, exposure to light, injection of additional fluid into the cavity 127, or physical pressure, for example. Another suitable fluid-precursor may be, for example, powder, such as a crystalline sucrose or a lyophilized solution. The powder within the cavity 127 can have a known amount and/or mass and may be configured to dissolve in water. In other embodiments, other fluid precursors may be used.

Figure 20A:
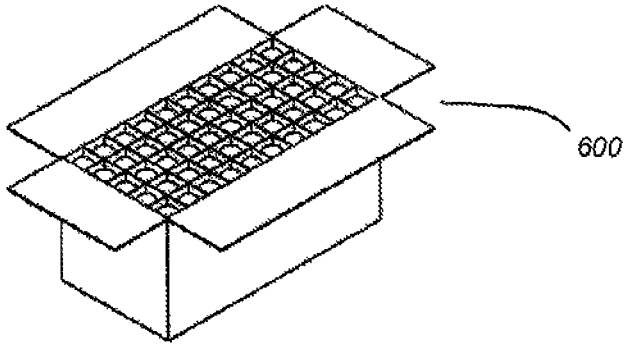
FIG. 20A depicts a perspective view of an embodiment of a bulk shipping configuration for the sterile packaging units disclosed herein.
Figure 20B:
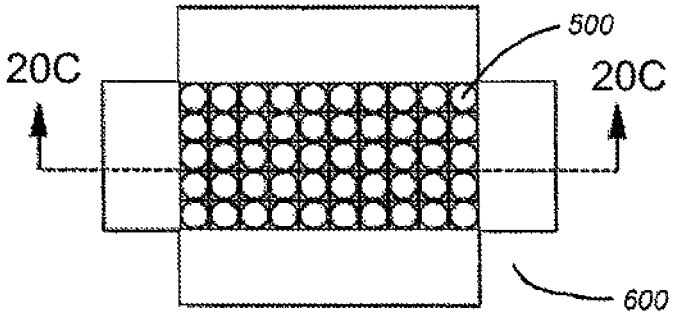
FIG. 20B depicts a distal view of the bulk shipping configuration embodiment illustrated in FIG. 14A.
Figure 20C:
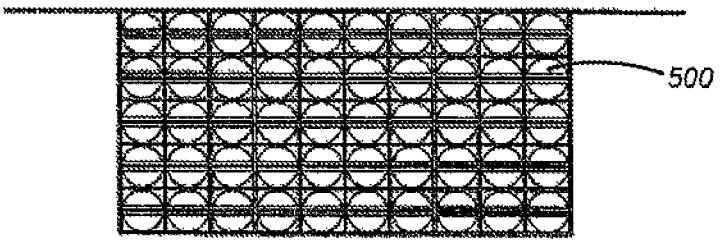
FIG. 20C depicts a cross-sectional view of the bulk shipping configuration embodiment illustrated in FIG. 14B.

A plurality of packaging units, such as those described above, may be packaged together into a kit for shipping and/or sale. One embodiment of a kit is provided in FIGS. 20A-20C. In such an embodiment, a plurality of shells 500 are stacked vertically and horizontally. The relatively spherical shape of each shell 500 allows them to be stacked into "egg" cartons, "egg" crates, or boxes. In another embodiment of a kit, a plurality of apparatuses 100 comprising nipple assemblies 130 of various sizes are packaged together. The nipple assemblies may differ in the size of their respective cavities 137, the diameter of their respective nipples 134, and/or the size of their respective nipple apertures 136. Alternatively or additionally, the volume and/or concentration of fluid stored within the cavity 137 may vary across the plurality of apparatuses 100. With such a configuration, the kits can be tailored to provide apparatuses 100 suitable for a spectrum of age groups.

The pacifier apparatus of various embodiments can be configured to couple, either directly or indirectly, to various accessories, making it a versatile tool for administering fluid or orally-administered medical instruments to young, infirmed, or disabled populations. For example, in some embodiments, the pacifier apparatus is configured to couple to a breast pump. In some such embodiments, the nipple cavity and the nipple aperture of the pacifier apparatus may be sized for receiving, storing, and dispensing colostrum and/or breast milk in amounts appropriate for neonates born at various gestational ages. Additionally, in some embodiments, the apparatus is configured to universally couple with various breast pump designs. In other embodiments, the apparatus can be configured to couple selectively with one or more breast pump designs, such as, for example, those manufactured by Ameda (e.g., Purely Yours®, Purely Yours Ultra™, etc.), Philips (e.g., AVENT), Bailey Medical (e.g., Nurture III), Evenflo (e.g., SimplyGo™) Hygeia (e.g., EnDeare™, EnJoye™, etc.), Medela (e.g., Pump In Style®, Freestyle®, Symphony®, Lactina®, Swing®, Harmony®, etc.), Simplisse®, or other manufacturer. Such breast pumps can include, for example, a breast shield or flange and a pumping mechanism and may optionally comprise a milk-storing container. The pumping mechanism may include, for example, a manual or electrical pump.

In some embodiments, a system for administering fluid includes, for example, a pacifier apparatus, such as, for example, any of the pacifier apparatus embodiments described previously herein, a breast pump as described in the preceding paragraph, and a connector or a means for connecting the breast pump directly or indirectly to at least a portion of the pacifier apparatus. In embodiments of the system having a direct connection between the breast pump and at least a portion of the pacifier apparatus, the connecting means can include, for example, a threaded connection, a fitted snap connection, or other suitable connection. In one such embodiment, the pacifier apparatus includes a nipple assembly and an insertable cartridge, such as, for example, the apparatus shown in FIGS. 12A-12D. A proximal cartridge portion is configured to removably attach directly to the breast pump such that colostrum and/or breast milk can be dispensed and stored in the reservoir of the cartridge. In another embodiment, the breast pump may removably attach directly to a distal end of a nipple assembly. Such a nipple assembly may be configured to securely attach to a second portion of the pacifier apparatus, which includes a balloon, a rigid member, and/or a pump, once the nipple assembly is removed from the breast pump.

In embodiments having an indirect connection between the breast pump and at least a portion of the pacifier apparatus, the connector or connecting means may include, for example, tubing, piping, a funnel, a blunt tip needle, and/or another conduit for directing the flow of fluids from the breast pump to the pacifier apparatus. A first end of the connector, a connecting mechanism, or a connecting means can be configured to attach, at least indirectly, to an outlet of the pumping mechanism or to an outlet in the milk-storing container. In some embodiments of the system, a second end of the connector, a connecting mechanism, or a connecting means is removably attached to the pacifier apparatus at the site of the nipple aperture. Threading or another coupling element may be present to secure the connector, a connecting mechanism, or a connecting means within the nipple aperture. In some embodiments, such as the apparatus shown in FIG. 22, a connector or connecting mechanism may attach to the valve 182 and valve threading 184. In balloon-less pacifier apparatus embodiments, such as, for example, those shown in FIGS. 10A-10C and 11A-11C, the connector, the connecting mechanism, or the connecting means may alternatively attach to the pacifier apparatus at or within an opening in either the nipple base or the pump of the pacifier apparatus.

In another embodiment of the system, the nipple assembly 130 has complementary threading or other securement feature such as a snap or friction fit to couple the nipple assembly 130 to a syringe, such as, for example, a syringe from Acacia Neonatal® syringe line. In one non-limiting example, the nipple assembly 130 has securement features designed to couple the nipple assembly 130 to the NuTrio TwistLok™ enteral syringe. The threading or other securement feature of the nipple assembly 130 may be identical or substantially similar to the securement features of a bottle, jar, or other container of fluid such that the syringe can couple interchangeably to the container and the nipple assembly 130. In some embodiments, the container is configured to hold 1 to 8 ounces of fluid. In some embodiments, the fluid in the container is a medication, such as an antibiotic, analgesic, numbing solution, or anti-gas solution (e.g., simethicone); in other embodiments, the fluid may be any fluid administered for the promotion of health, such as, a vitamins, probiotics, nutraceuticals, colostrum, breast milk, sugar solutions (e.g., sucrose), juices, electrolytes, vaccines, or nutritional supplements. In some embodiments, the nipple assembly 130, the syringe, and the container may all be packaged as a kit.

Various embodiments of the pacifier apparatuses are configured to minimize the risk of choking. The pacifier apparatuses of some embodiments have no removable or loose parts. For example, in some embodiments, each pacifier apparatus is molded to have a unitary body design; in other embodiments, all components of the pacifier apparatus are permanently coupled to form a single unit. In some such embodiments, the diameter of the pacifier apparatus 100 at its widest location is at least 1.25 inches, and in some embodiments, the length of the apparatus 100 at its longest location is at least 2.25 inches. In other embodiments, each pacifier apparatus is formed of a separable nipple assembly and a separable cartridge. In some such embodiments, the length and diameter dimensions of the each removable part are selected so as not to pose a choke hazard to young children. For example, in some embodiments, the diameter of the nipple assembly 130 at its widest location is at least 1.25 inches, and the length of the nipple assembly 130 at its longest location is at least 2.25 inches. Similarly, in some embodiments, the diameter of the cartridge (for example, cartridge 200 or 300) at its widest location is at least 1.25 inches, and the length of the cartridge at its longest location is at least 2.25 inches.

Figure 21:
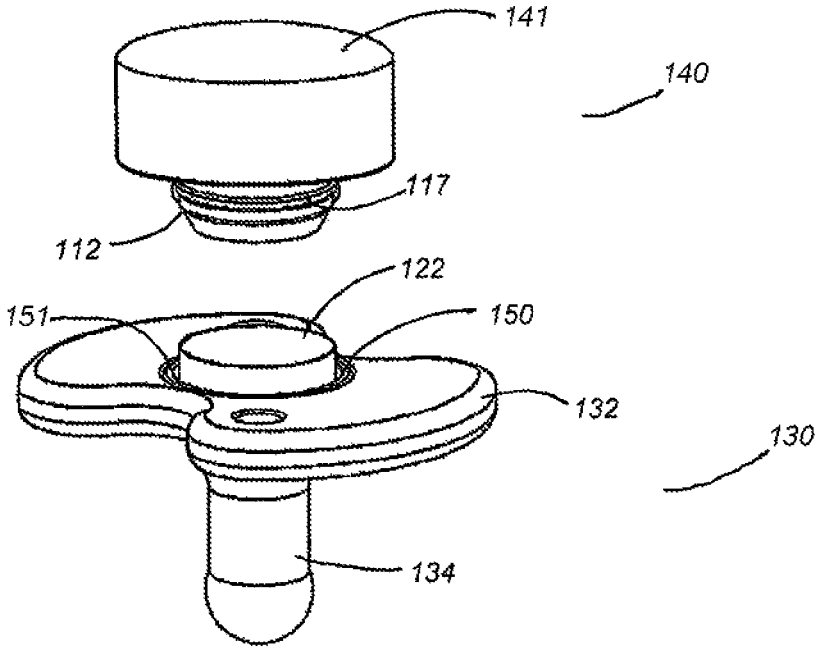
FIG. 21 depicts a perspective view of an embodiment of a method of assembling one embodiment of a pacifier apparatus configured for the oral administration of fluids.

FIG. 21 illustrates one embodiment of a method for manufacturing some of the apparatuses 100 disclosed above. In the embodiment, a nipple assembly 130 is molded such that it includes, for example: a nipple base 132 having a proximal face 133, a distal face 131, and a passage extending through the nipple base 132; and a nipple 134 extending proximally outward from the proximal face 133 and including a nipple wall 135, which defines a cavity 137. A nipple aperture 136 is formed through a proximal end of the nipple wall 135. The nipple aperture 136 may be formed, for example, by making a slit in the nipple wall 135, using a gauge needle or other apparatus to puncture a hole into the nipple wall 135, or using any other suitable means. In some embodiments, a balloon 120 is inserted through the passage of the nipple base 132 and into the cavity 137. In some such embodiments, at least a proximal end of a rigid member 112 is inserted into a distal mouth 122 of the balloon 120 such that the rigid member 112 may be fixedly coupled directly or indirectly to the passage wall upon insertion. In some embodiments, such as the embodiment of FIG. 15, the rigid member 112 may be tapered to facilitate insertion into the distal mouth 122 of the balloon 120. Additionally, the cavity 137 is filled with a specified volume of liquid.

In another embodiment, the method of manufacturing a fluid apparatus, such as any of the apparatus 100 embodiments described above, includes, for example, positioning a distal mouth 122 of a balloon 120 around at least a proximal portion of a rigid member 112 such that an air passage exists between a body 124 of the balloon 120 and a hole 104 located on a distal portion of the rigid member 112 or on a pump 141 coupled to the distal portion of the rigid member 112. The method also includes, for example, permanently affixing the distal mouth 122 to at least the proximal portion of the rigid member 112, and vacating air from the air passage to retract the balloon 120 into an undeployed state. A nipple assembly 130 is formed, which includes a nipple base 132 and a nipple 134. The nipple base 132 includes, for example, a proximal face 133, a distal face 131, and a passage extending through the nipple base 132. The nipple 134 extends proximally outward from the proximal face 133 and comprises a nipple wall 135, which defines a cavity 137. The method further may include securely affixing the balloon mouth 122 and at least the proximal portion of the rigid member 112 to a wall 138 of the passage, forming a nipple aperture 136 through a proximal tip of the nipple wall 135, and vacating air from the cavity 137. Vacating air from the cavity 137 may include removing (e.g., vacuuming or sucking) air from the cavity 137 through the nipple aperture 136 or expelling air through the nipple aperture 136 by transitioning the balloon 120 into a fully deployed state, for example. At some stage of the method, the cavity 137 also may be filled with a desired volume of liquid. Filling the cavity 137 with a volume of liquid may include, for example, injecting the volume of liquid into the cavity 137 through the nipple aperture 136. Alternatively, it may include any other suitable method of filling the cavity 137, such as, for example, squeezing the pump 141, inserting the nipple aperture 136 into a liquid, releasing the pump 141, and removing the nipple aperture 136 from the liquid when a desired quantity of the liquid has entered the cavity 137. The method may additionally include, for example, sealing the nipple aperture 136 and/or the hole 104 temporarily so as to prevent fluid from spilling from the cavity 137. Any other method of manufacture, which successfully manufactures the apparatus 100 of various embodiments, may be used without departing from the teachings or spirit of the disclosure.

The various methods of manufacturing any of the above-described pacifier apparatuses may be tailored so as to create an age-specific and/or procedure-specific pacifier apparatus. In some embodiments, the apparatuses are designed to control the rate of ingestion of a liquid, such as a medicament or nutritional supplement. For example, before molding or otherwise forming the nipple assembly 130, it may be advantageous to: determine an average number of sucks performed in a defined length of time by patients of a pre-defined age group; determine a desired length of fluid administration; determine a desired volume of fluid to be administered; calculate an optimum flow rate by dividing the desired volume by the desired length of fluid administration; calculate an optimum volume of fluid expelled per suck by dividing the optimum flow rate by the average number of sucks performed in a defined length of time; and select a desired nipple wall 135 thickness, a desired nipple wall 135 density, a desired cavity 137 volume, a desired nipple aperture 136 size, and/or a desired size of a distal cavity opening 104, such that an apparatus 100 with these desired characteristics is configured to achieve a desired average pressure change within the cavity 137 during a suck and thereby achieve the optimum volume of fluid expelled per suck. The apparatus 100 can then be formed having the desirable age-specific and/or procedure-specific characteristics mentioned above. In one non-limiting example, a pacifier apparatus 100 is designed for the average infant. In some studies, the average infant sucks on a bottle between 50-90 times per minute, creating a negative pressure which induces liquid to flow from the bottle into the infant's mouth. With a bottle, the sucking pressure achieved by the average infant during nutritive sucking is −87.5±28.5 mm Hg. In some embodiments, it is optimal to create an apparatus that achieves similar pressure values. As described above, the pressure achieved within a pacifier apparatus 100 is dependent on a plurality of factors, including, for example, the material characteristics of the nipple wall 135, the volume of the liquid, the diameter of the nipple aperture 136, and where applicable, the diameter of the receiving tube 160. In some embodiments, various characteristics of the apparatus 100, including the diameter of the receiving tube 160, are selected such that a pressure of −144.5 mm Hg to −30.5 mm Hg, and preferably, a pressure of −116 mm Hg to −59 mm Hg, or any sub-range or value therebetween is achieved, when the apparatus 100 is used by an individual sucking at an average rate and average force for an infant.

A method of manufacturing a nipple assembly 130 having a receiving tube 160 is also disclosed. The nipple assembly 130 may include some or all the features described elsewhere herein. In some embodiments, the shape of the nipple assembly 130, complete with a receiving tube 160, a nipple aperture 136, and optionally a valve 182 and/or a plug 170 and strap 180 are formed as a single piece, for example, through molding or 3-D printing. In other embodiments, the nipple aperture 136 and/or the receiving tube 160 are added after the nipple and nipple base have formed. In some embodiments, the nipple aperture 136 includes, for example, one or more of a valve, a hole, a slit, and a frangible seal. The nipple aperture 136 may be manufactured with an open slit having a length between 0.005" and 0.1". In some embodiments, the slit may be oriented to help control the rate of fluid flow. For example, a slit may be molded in the nipple aperture 136 that is substantially parallel to the orientation of the user's mouth and lips. In another embodiment, the nipple aperture 136 slit may be perpendicular to the orientation of the user's mouth and lips. A slower fluid flow rate is achieved when the slit in the nipple aperture 136 is parallel to the user's mouth. In some embodiments, the proper directionality of the nipple assembly may be determined by the nipple base 132. For example, the nipple base 132 may be visually marked to indicate proper orientation. In some embodiments, instructions on the nipple base 132 or the packaging indicate that the nipple aperture slit should be substantially parallel to a user's mouth to achieve a relatively slow flow rate and perpendicular to a user's mouth to achieve a faster flow rate.

In some embodiments, a method of administering medicine or fluid to a user includes removing or partially removing a cartridge seal 340 from a cartridge 300 to expose a cartridge spout 320. The method further includes inserting the spout 320 into the receiving tube 160 of a nipple assembly 130. To limit unintentional expulsion of the fluid, the cartridge 300 is held by the tab 350 and/or gripping portions 360 during insertion. The cartridge 300 may be twisted, snapped, or otherwise secured into place in the receiving tube 160. The apparatus is placed into a user's mouth, optionally, with a specific orientation to achieve a particular strength of flow. The fluid may be expelled by sucking on the nipple 136 or actuating the cartridge body 310.

As noted above, some embodiments relate to methods of using the apparatuses and systems described herein. For example, some embodiments relate to methods of providing comfort, alleviating pain, and/or treating an illness or medical condition. Examples of such situations include, without limitation, circumcision procedures, venipuncture, diagnostic procedures, upset stomach, gas, bowel movements, colds, flu, fever, and the like. The methods can include identifying a patient (e.g., an infant or neonate) and providing an apparatus as described herein to the patient where the device includes a desired fluid substance for the particular condition. For example, for a circumcision or venipuncture, the infant can be given the apparatus filled with a sugar solution, a pain medication (e.g., acetaminophen), etc. at a desired time prior to (e.g., 1-2 minutes prior to the procedure) or at the commencement of the procedure. If the infant is unable or unwilling to suck so as to receive a sufficient amount of the fluid, then the caregiver, doctor, or guardian can actuate the pump to assist in expelling an adequate amount, if the pump is included in the design. The methods can include the use of apparatuses with a measured volume of the particular solution according to the recommended dosage and/or duration of the procedure. The apparatus can be configured to expel a sufficient dosage of the solution over a desired period of time, such as the length of the pre-procedure time period, procedure time period, and/or any post-procedure time period. Examples of solutions include medications, such as antibiotics, analgesics, numbing solutions, anti-gas solutions (e.g., simethicone), vitamins and minerals, colostrum, breast milk, sugar solutions (e.g., sucrose), juices, electrolytes, vaccines, nutrient formulas, etc.

The foregoing description details certain embodiments of the systems, devices, and methods disclosed herein. It will be appreciated, however, that no matter how detailed the foregoing appears in text, the devices and methods can be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated. The scope of the disclosure should therefore be construed in accordance with the appended claims and any equivalents thereof.

It will be appreciated by those skilled in the art that various modifications and changes may be made without departing from the scope of the described technology. Such modifications and changes are intended to fall within the scope of the embodiments, as defined by the appended claims. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" should be interpreted as "including but not limited to," the terms "comprising" and "having" should, respectively, be interpreted as "comprising at least" and "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an." In general, "a" and/or "an" should be interpreted to mean "at least one" or "one or more"; the same holds true for the use of definite articles used to introduce claim recitations. Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or, "B" or "A and B."

Although the technology has been described with reference to embodiments and examples, it should be understood that numerous and various modifications can be made without departing from the spirit of the invention. Accordingly, the technology is limited only by the following claims.

What is claimed is:

1. A fluid dispensing apparatus, comprising:

a cartridge pre-filled with a pre-measured dose of a liquid, the cartridge comprising:

a cartridge body having a distal end and a proximal end and defining a reservoir, and a cartridge spout formed of an elongated tubular side wall extending proximally from the proximal end of the cartridge body and terminating at an aperture at a proximal tip of the cartridge spout; and a cartridge seal attached to the proximal tip of the cartridge spout to prevent liquid from leaking from the aperture prior to use, wherein:

the cartridge seal hermetically seals the liquid within the cartridge, the cartridge seal is fully detachable from the cartridge so as to expose the aperture without exposing any portion of the reservoir, in a first configuration, prior to detaching, the fully detachable cartridge seal extends across the proximal tip of the cartridge spout and along the entire length of the cartridge body from the proximal tip to at least the distal end of the cartridge body, and in a second configuration, following detachment of the cartridge seal, the cartridge spout extends freely from the cartridge body such that an outer surface of the tubular side wall lacks any contact with any other portion of the cartridge.

2. The fluid dispensing apparatus of claim 1, wherein a connection between the cartridge seal and the cartridge is perforated or indented to facilitate breakage of the cartridge seal from the cartridge.

3. The fluid dispensing apparatus of claim 1, further comprising a tab attached to a distal end of the cartridge body, wherein the tab remains attached to the cartridge following removal of the cartridge seal.

4. The fluid dispensing apparatus of claim 3, wherein the cartridge has a width of at least 1.25 inches or a length of at least 2.25 inches.

5. The fluid dispensing apparatus of claim 4, wherein the length is measured from a distal tip of the tab to the proximal tip of the cartridge spout.

6. The fluid dispensing apparatus of claim 1, wherein the cartridge seal and the cartridge each individually have a width of at least 1.25 inches or a length of at least 2.25 inches.

7. The fluid dispensing apparatus of claim 1, wherein the cartridge seal and the cartridge are each configured to withstand a force of at least 1 lb without failing.

8. The fluid dispensing apparatus of claim 1, wherein the cartridge comprises an actuation feature configured to expel fluid from the cartridge.

9. The fluid dispensing apparatus of claim 1, wherein the cartridge body comprises an actuatable bulbous portion.

10. The fluid dispensing apparatus of claim 9, wherein the cartridge body further comprises a recessed gripping portion forming a distal portion of the reservoir, wherein the recessed gripping portion is less flexible than the actuatable bulbous portion so as to limit unintentional expulsion of fluid when handling the cartridge.

11. The fluid dispensing apparatus of claim 1, wherein at least a portion of the cartridge body is deformable.

12. The fluid dispensing apparatus of claim 1, wherein the premeasured dose of liquid comprises 0.01 mL to 10.0 mL of liquid.

13. The fluid dispensing apparatus of claim 1, wherein the liquid is selected from the group consisting of an antibiotic, an analgesic, a probiotic solution, a numbing solution, an anti-gas solution, vitamins and minerals, colostrum, breast milk, a sugar solution, juice, electrolytes, a vaccine, and a nutrient formula.

14. The fluid dispensing apparatus of claim 1, wherein the cartridge is formed of one or more polymers or polymer composite materials.

15. The fluid dispensing apparatus of claim 1, wherein the cartridge spout is formed such that, following detachment of the cartridge seal, the elongated tubular side wall fits securely within a medical instrument.

16. A fluid dispensing apparatus, comprising:

a cartridge pre-filled with a premeasured dose of a liquid, the cartridge comprising:

a cartridge body defining a reservoir, and a cartridge spout extending proximally from the cartridge body and terminating at an aperture, wherein the reservoir comprises a gripping element forming a distal portion of the reservoir, the gripping element being less flexible than the remainder of the reservoir so as to limit actuation of the reservoir when gripped;

a cartridge seal attached to a proximal tip of the cartridge spout to prevent liquid from leaking from the aperture prior to use, wherein:

the cartridge seal hermetically seals the liquid within the cartridge, the cartridge seal is: detachable from the proximal tip of the cartridge spout, permanently coupled to the cartridge at a location distal to and remote from the cartridge spout, and lacking any locations of connection along an elongated tubular side wall defining the cartridge spout, and a proximal cartridge seal portion positioned proximal to the location of permanent coupling is moveable away from the cartridge aperture once the cartridge seal is detached from the proximal tip of the cartridge spout; and a tab attached to a distal end of the cartridge body, wherein the tab remains attached to the cartridge following partial removal of the cartridge seal.

17. The fluid dispensing apparatus of claim 16, wherein a portion of a connection between the cartridge seal and the cartridge is perforated or indented to facilitate breakage of the cartridge seal from a portion of the cartridge.

18. The fluid dispensing apparatus of claim 16, wherein the cartridge has a width of at least 1.25 inches or a length of at least 2.25 inches.

19. The fluid dispensing apparatus of claim 18, wherein the length is measured from a distal tip of the tab to the proximal tip of the cartridge seal.

20. The fluid dispensing apparatus of claim 16, wherein the proximal cartridge seal portion and the cartridge each individually have a width of at least 1.25 inches or a length of at least 2.25 inches.

21. The fluid dispensing apparatus of claim 16, wherein the cartridge seal and the cartridge are each configured to withstand a force of at least 1 lb without failing.

22. The fluid dispensing apparatus of claim 16, wherein the cartridge comprises an actuation Feature configured to expel fluid from the cartridge.

23. The fluid dispensing apparatus of claim 16, wherein the cartridge body comprises an actuatable bulbous portion.

24. The fluid dispensing apparatus of claim 16, wherein the gripping element comprises a recessed gripping portion.

25. The fluid dispensing apparatus of claim 16, wherein the premeasured dose of liquid comprises 0.01 mL to 10.0 mL of liquid.

26. The fluid dispensing apparatus of claim 16, wherein the liquid is selected from the group consisting of: an antibiotic, an analgesic, a probiotic solution, a numbing solution, an anti-gas solution, vitamins and minerals, colostrum, breast milk, a sugar solution, juice, electrolytes, a vaccine, and a nutrient formula.

27. The fluid dispensing apparatus of claim 16, wherein the cartridge is formed of one or more polymers or polymer composite materials.

28. The fluid dispensing apparatus of claim 16, wherein the cartridge spout has a circular cross-section with an outer diameter between 0.01 mm and 12.0 mm.

29. The fluid dispensing apparatus of claim 16, wherein the cartridge spout is formed such that, following detachment of the cartridge seal, the elongated tubular side wall fits securely within a medical instrument.

* * * * *